US009888783B2

(12) United States Patent
Hui

(10) Patent No.: US 9,888,783 B2
(45) Date of Patent: Feb. 13, 2018

(54) MATTRESS STRUCTURE AND A METHOD USING THE CHARACTERISTICS OF THE MATTRESS STRUCTURE FOR UNDERSTANDING AND DECIDING SUITABILITY OF THE MATTRESS STRUCTURE

(71) Applicant: Glorious Master Limited, Road Town, Tortola (VG)

(72) Inventor: Cheung Wing Hui, Hong Kong (CN)

(73) Assignee: GLORIOUS MASTER LIMITED, Road Town, Tortola (VG)

( * ) Notice: Subject to any disclaimer, the term of this patent is extended or adjusted under 35 U.S.C. 154(b) by 0 days.

(21) Appl. No.: 14/386,106

(22) PCT Filed: Feb. 8, 2014

(86) PCT No.: PCT/CN2014/000144
§ 371 (c)(1),
(2) Date: Sep. 18, 2014

(87) PCT Pub. No.: WO2014/121665
PCT Pub. Date: Aug. 14, 2014

(65) Prior Publication Data

US 2015/0082550 A1 Mar. 26, 2015

(30) Foreign Application Priority Data

Feb. 8, 2013 (CN) ..... 2013 1 0050645
Feb. 8, 2013 (HK) ..... 13101804.9

(51) Int. Cl.
*A47C 27/00* (2006.01)
*A47C 27/14* (2006.01)
*A47C 27/15* (2006.01)

(52) U.S. Cl.
CPC ..... *A47C 27/001* (2013.01); *A47C 27/144* (2013.01); *A47C 27/148* (2013.01); *A47C 27/15* (2013.01); *Y10T 29/481* (2015.01)

(58) Field of Classification Search
CPC ..... A47C 27/001; A47C 27/148; A47C 27/16; A47C 27/18; A47C 27/20; A47C 27/144; A47C 27/15; Y10T 29/481
See application file for complete search history.

(56) References Cited

U.S. PATENT DOCUMENTS 5,423,099 A * 6/1995 Gulli ..... A47G 9/10 5/638
5,513,402 A * 5/1996 Schwartz ..... A47C 23/00 5/691

(Continued)

FOREIGN PATENT DOCUMENTS

CN 2801121 Y 8/2006
CN 2845591 Y 12/2006

(Continued)

OTHER PUBLICATIONS

Craftmatic Adjustable Beds; https://web.archive.org/web/20121102094811/http://www.craftmatic.com:80/compare.php; Nov. 2, 2012.*

(Continued)

*Primary Examiner* — Eric J Kurilla
(74) *Attorney, Agent, or Firm* — Leydig, Voit & Mayer

(57) ABSTRACT

A mattress structure for providing different degrees of relief or support to various body parts of a user or in accordance with different body lengths of the users. The mattress structure includes a principal axis and two or more relief units, distributed in different positions along the principal axis. At least one relief unit provides a degree of relief different from that of another relief unit, to define a relief layer that provides different degrees of relief corresponding (Continued)

Figures 1A, 1B:
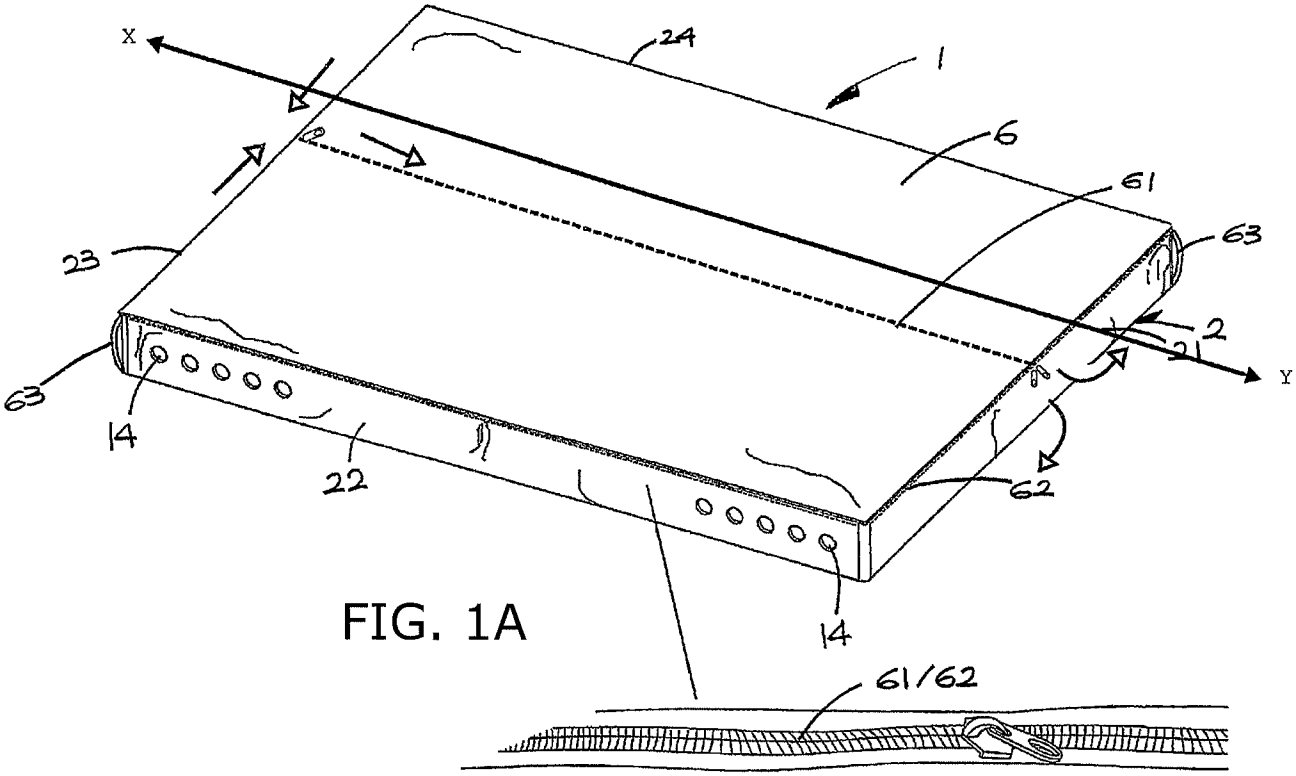

to various parts of the body. The relief layer is dividable into two or more relief zones and these zones are divided according to the body parts of the user. The relief units in a relief zone are inter-changeable or re-arrangeable according to needs of the user for accommodating users of different body heights and different lengths of various body parts.

24 Claims, 24 Drawing Sheets

(56) References Cited

U.S. PATENT DOCUMENTS

| | | | | |
|---|---|---|---|---|
| 6,807,698 | B2 | 10/2004 | Torbet et al. | |
| 6,854,144 | B1 * | 2/2005 | Mehring, Jr. | A47C 27/20 5/722 |
| 7,493,668 | B2 | 2/2009 | Piraino | |
| 7,536,740 | B1 * | 5/2009 | Swartz | A47C 20/026 5/630 |
| 7,661,166 | B1 | 2/2010 | Marling et al. | |
| 7,757,322 | B2 | 7/2010 | An | |
| 8,356,371 | B2 | 1/2013 | Howard | |
| 8,370,979 | B2 | 2/2013 | Fukano | |
| 8,832,888 | B2 * | 9/2014 | Chunglo | A47C 27/144 5/724 |
| 2002/0020022 | A1 * | 2/2002 | Bernstein | A47C 20/025 5/722 |
| 2008/0093784 | A1 * | 4/2008 | Rawls-Meehan | A47C 7/027 267/80 |
| 2008/0201856 | A1 * | 8/2008 | Howard | A47C 27/001 5/690 |
| 2008/0201860 | A1 * | 8/2008 | Malzl | A47C 27/001 5/727 |
| 2009/0056031 | A1 * | 3/2009 | Liegel | A47C 20/026 5/725 |
| 2009/0100606 | A1 * | 4/2009 | An | A47C 27/001 5/716 |
| 2009/0235460 | A1 * | 9/2009 | Hitch | A47C 7/021 5/654 |
| 2011/0004998 | A1 * | 1/2011 | Losio | A47C 23/002 5/699 |
| 2013/0283538 | A1 * | 10/2013 | Young | A47C 21/046 5/724 |
| 2015/0082550 | A1 * | 3/2015 | Hui | A47C 27/001 5/727 |

FOREIGN PATENT DOCUMENTS

| | | | |
|---|---|---|---|
| CN | 201248526 | Y | 6/2009 |
| CN | 201263537 | Y | 7/2009 |
| CN | 102613836 | A | 8/2012 |
| CN | 103417029 | A | 12/2013 |
| DE | 20 2007 011 398 | U1 | 11/2007 |
| DE | 10 2011 001 | A1 | 9/2012 |
| EP | 1 803 375 | A2 | 7/2007 |
| JP | 2003125899 | A | 5/2003 |
| JP | 2004049353 | A | 2/2004 |
| WO | WO 2005/002400 | A1 | 1/2005 |

OTHER PUBLICATIONS

State Intellectual Property Office of the People's Republic of China; Office Action in International Patent Application No. PCT/CN20141000144 (dated May 14, 2014).

Hong Kong Patent Office; Search Report in Hong Kong Patent Application No. 13101804.9 (dated Apr. 12, 2013).

Hong Kong Patent Office; Search Report in Hong Kong Patent Application No. 13101804.9 (dated Mar. 28, 2014).

Hong Kong Patent Office; Search Report in Hong Kong Patent Application No. 13101804.9 (dated May 25, 2014).

* cited by examiner

Female

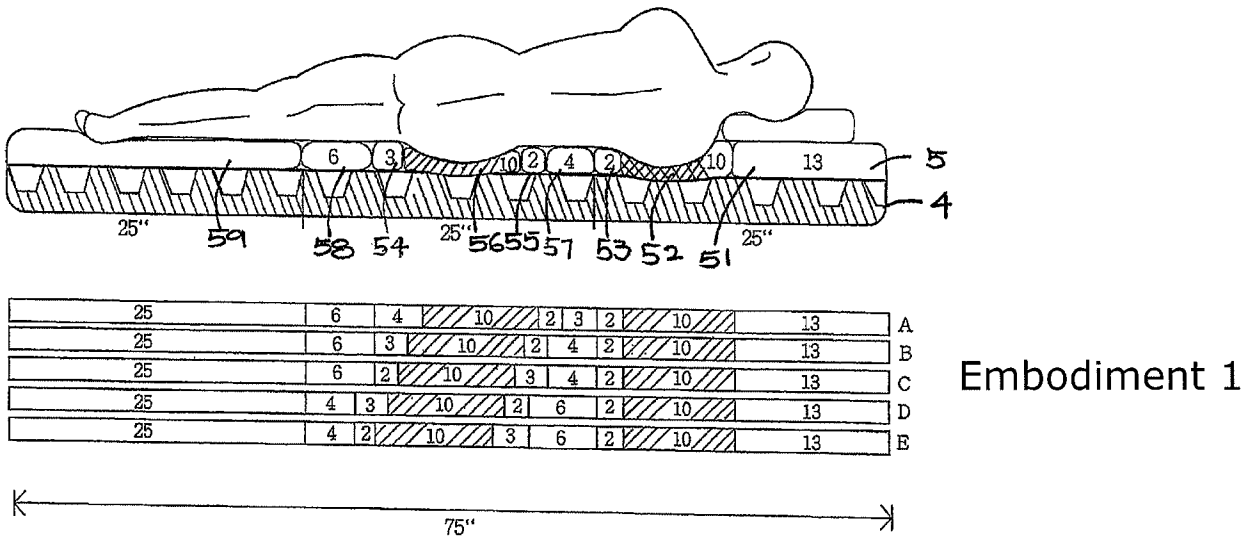
Embodiment 1
A
B
C
D
E
75"
25"
25"
25

Embodiment 2

Embodiment 1

Embodiment 3

MATTRESS STRUCTURE AND A METHOD USING THE CHARACTERISTICS OF THE MATTRESS STRUCTURE FOR UNDERSTANDING AND DECIDING SUITABILITY OF THE MATTRESS STRUCTURE

BACKGROUND OF THE INVENTION

As publicly known, a good mattress can improve sleep quality. It is however not easy to find a good mattress, for the reason that each individual has their own age, body shape and weight, as well as diversified supporting needs. Everyone has also their own sleep habits and preference for firmness of the mattress. It is not easy for a mattress to satisfy at the same time different needs of a couple, as they differ in age, body shape and build and sleep habits. Even if one is able to come up with a mattress satisfying their present needs, the mattress in general would be used for 10 years or more, during which time changes in the user's age, body conditions and shape would occur. A mattress would normally take physical damage as time passes, without the ability to keep up with constant changes in the user's needs. It is thus even harder to come up with a mattress tailor-made to the body shape and build of the user and at the same time with the ability to constantly satisfy different needs in support brought along by personal changes.

As the lifespan of human increases, finding a way to allow the pillar of the human body—the spine—to work with the aging body is becoming imminent. After 40 years of intensive research on bedding and reference to considerable literature on spinal care and healthy sleep, the inventor concludes that it is in fact not difficult to improve the function of the spine and extend its life, where a suitable pillow and a capable mattress are all it takes. With the combination of the two, it is estimated (non-clinically) that the spine would be able to at least function for a term 20-30% longer. Looking at mattresses in the market throughout the world, no matter how luxurious they are in their appearance, none of them can be said capable.

A. Manufacturers' Lack of Understanding of the Body Structure Unique to Each Individual 1. As publicly known, the spine is the pillar of the body supporting the whole torso and maintaining its agile movements. The spine has an S-shape as its natural biological curves. A cross section of the spine when sleeping on the back would generally reveal that the cervical vertebrae and the lumbar vertebrae are arched upwards. Taking into account the hip bulging downwards, there would be 3 to 5 inches of difference in level between the lumbar vertebrae and the hip.

2. The spine is prone to fatigue during daytime when working, sitting, standing and walking. Sleeping is the only time when the spine can take full rest. When sleeping, two pressure points are created on the body: the shoulder (particularly noticeable for a male sleeping on his side) and the hip (particularly noticeable for a female with a generally wider pelvis). The key to quality sleep lies in suitable relief for these pressure points and thus effective protection for the S-shaped spine with its natural biological curves.

3. Near the hip of the human body exists a body part colloquially known as the "low back". The low back initiates movements of the whole upper body and endures frequently tension caused by lateral swinging motions. It can be described as the part that is most fragile and most heavily stressed (see figure). Activities during daytime cause strain to the low back, which is desirable to be healed and relieved by taking rests and sleeps. Due to its proximity to the hip and the difference in level and weight between the low back and the hip, the low back is lifted by the hip when lying on the back and loses the support it needs. It is thus obvious that the low back is the part most prone to fatigue and injury. Without sufficient healing, "low back strain" will occur in the long run. When the low back is stressed for days and nights without relief, adjacent fasciae and nerves would naturally become stiff and induce hyperaemia, causing inflammation, pain, muscular stiffness and numbness in the long run. In the worst scenario, permanent spinal tuberculosis may form besides the lumbar, affecting normal activities.

Apart from the abovementioned structure of the human body, of higher importance are the differences in body shape and build between each individual. In theory, each individual needs their own unique support for the back. However, mattresses in the market in general cannot satisfy each individual's biological needs.

B. Defects in Mainstream Closed Mattresses in the Present Market

1. Unitary Firmness without Precisely Defined Support Zones

The mattress has adopted a closed and unitary structure since its advent some 80 years ago. Despite the fact that different mattresses may vary in their firmness, most would only offer one kind of such. The material used in the mattress is decided by the manufacturer, leaving no room for customization by the customer.

2. Incapability to Support Diversified Body Shapes with Vaguely Defined Zones

As technologies progress, recent years have seen occasional attempts by manufacturers to define mattress zones according to firmness, albeit without succeeding in precisely matching the S-shaped curves of different bodies. The first reason for this is that it is not possible for the manufacturer to predict each individual's height, weight and body shape. How pressures points of the user can be addressed as seen in advertisements is in fact empty words, nothing more than propaganda. The second reason lies in the diameter of an individual coil being at least 6 to 7 cm and along with the intervals between coils, it is not possible to fit precisely each individual's body shape. Due to the difference in height between individuals, the position and zone of the pressure points even in the same body part varies considerably. The subtle difference in supporting needs cannot be addressed by simply dividing the mattress vaguely into "head", "body" and "leg" zones. Such subtle mismatch translates into a substantial issue in application. Owing to the differences in body build, it is conceivable that a unitary mattress would not be able to satisfy individual's needs between a couple sleeping in the same bed.

3. Pain in the Low Back, the Suspended Body Part Forgotten

According to a medical survey, 60% to 70% people in the middle age suffer low back strain, which is mostly caused by insufficient support when sleeping on the back, instead of merely the outcome of labour. Coil mattresses with a unitary and closed structure rarely provide substantial support for the low back, for the reason that the hip below the low back is in general heavier. Under physical traction, the surface of the mattress underneath the hip would generally collapse, thereby removing support for the low back, suspending and stressing it, preventing relaxation of the same. This issue is however commonly ignored or unresolved by mattress manufacturers. Therefore, mattresses in the market are incapable of extending the life of the spine, and worse still may indirectly cause damage and accelerate its degradation.

4. The Individual Coil Misnomer

In the past decade, the coil design of the closed coil mattress has been filled with gimmicks such as "individually wrapped coils", "continuous coils", "tied coils", "extra-thin, extra-dense, extra-count coils" and "double/triple layer coils". Objectively speaking, some of them brought about some changes, being convincing at least in their names. For example, the advertisement of "individually wrapped coils" is appealing to some: a wine glass filled with champagne is put on one side of a coil and a bowling ball is dropped onto the other side. The wine glass in the advertisement remains motionless. Many are tricked by such representation of "individual wraps". Taking a closer look, however, a clear plastic plate is placed underneath the wine glass, and the coils are literally "individual". In reality, an "individually wrapped coil" mattress does not come with a clear plastic plate, and some material has to be connected in between the coils for shaping purpose. 3 to 6 protective layers, supportive layers and comfort layers have to be placed on top and at the bottom of the coils. Topped with a fancy cover, the coils are obviously less "individual". Dropping a bowling ball onto such mattress may even cause movement to someone lying thereon.

5. The Backfiring Competition in Thickness and Fanciness

The trend in recent years in coil mattress design has been on thickness and fanciness, leading to increasing sizes and weights easily reaching 60 to 70 kg. All coil mattresses, however, are prone to metal fatigue. To extend the durability and life of the mattress, customers paying for the product are required, despite difficulty, to flip regularly the bulk of the mattress weighing 60 to 70 kg. Such action is not only a torture to the user, but also a joke in the consumer industry.

In addition, nuisance and waste are caused by the delivery of the bulk of the mattress. In particular, old multi-storey buildings may not be fitted with an elevator, or one that is large enough for such bulky mattress. Lifting equipment is therefore required to be set up outside of the building in order to deliver the mattress to the floor in question, thereby incurring costs and nuisance. In an even worse scenario, delivery personnel have to carry the mattress upstairs where lifting equipment cannot be set up. Such delivery may lead to work injury, adding a burden to public medical services. It may also cause unnecessary damage to public facilities and upholstery along the staircase.

6. Closed Mattresses as Hotbeds for Bacteria and Mites

Generally speaking, closed unitary coil mattresses of various kinds are faced with a number of serious deficiencies, causing worries and trouble to the user. In particular, the materials used in the mattress remain unknown to the user. Even if the coils and materials are corroded or moulded, infested with bacteria or mites, or even causing odor, the user can do nothing due to the size and closed structure of the mattress. Knowingly accepting the fact that bacteria, mites and odor are building up and developing and at the same time having nightly sleeps with them is one of the biggest ironies to the technologically advanced world of the present day.

SUMMARY OF THE INVENTION

This invention is related to a mattress structure, in particular but not exclusively of a mattress structure that can be disassembled.

According to the first aspect of the invention there is provided a mattress structure for providing different degrees of relief or support to various body parts of a user or in accordance with different body lengths of the users, the mattress structure comprising: a principal axis; two or more relief units, distributed in different positions along the principal axis, wherein at least one relief unit provides a degree of relief different from that of another relief unit, to thereby define a relief layer that provides different degrees of relief corresponding to various parts of the body, the relief layer being dividable into two or more relief zones and these zones are divided according to the body parts of the user, at least one or more of the relief zones being made up of relief units of different sizes, at least one relief unit being a main relief unit which provides a relief ability greater than that of another relief unit, the relief units in a relief zone being inter-changeable or re-arrangeable according to needs of the user to change the position of the main relief unit relative to the other relief units within the zone, for accommodating users of different body heights and different lengths of various body parts.

Preferably, the mattress structure includes three relief zones, corresponding to shoulders, hips and legs of a user.

Preferably, the shoulder and hip zones each includes two or more relief units which are interchangeable or re-arrangeable according to needs of a user.

Preferably, the main relief unit in the relief zone is interchangeable or relatively moveable with respect to other relief units in the zone.

Preferably, the shoulders and hips relief zones each includes a main relief unit, the two main relief units are interchangeable or re-arrangeable or relatively moveable in accordance with personal needs of a user.

Preferably, one of the relief units in the relief zone is the main relief unit, the main relief unit has a dimension along the principal axis being designed such that inter-changing of position of the main relief unit relative to other relief unit in the same zone permits the position of the main relief unit to be adjusted along the principal axis by unit length.

Preferably, the main relief units in the two relief zones provide different relief abilities.

Preferably, the relief layer is formed from relief units of different sizes, two main relief units are interchangeable or relatively moveable according to user needs for accommodating users of different height and body parts with different lengths.

Preferably, the relief units are made of material of different density for providing different relief abilities.

Preferably, the relief units are made of material with different hardness for providing different relief abilities.

Preferably, the mattress structure further Comprises one or more support layer positioned below the relief layer.

Preferably, the support layer includes two or more independent support units.

Preferably, the support layer includes a resilient layer.

Preferably, the mattress structure further comprises a chassis for containing the relief unit.

Preferably, the chassis is divided into two or more chassis zones corresponding to position of body parts of the user or position of the two or more relief zones.

Preferably, the chassis contains at least two relief units huddled together for maintaining their relative positions.

Preferably, the chassis further contains a support unit.

Preferably, at least one of the chassis zones contains three relief units and one support unit.

Preferably, at least one of the chassis zones contains five relief units and one support unit.

Preferably, the chassis has a wall and the wall is tall enough to overlap with part of the thickness of the relief unit.

Preferably, the chassis is made of flexible material.

Preferably, the relief layer is capable of being independently placed on conventional mattress for use.

Preferably, the mattress structure includes one or more comfort layer, the comfort layer is placed above the relief layer for concealing unevenness of the relief units and to form an even surface.

Preferably, the relief layer includes an aperture.

Preferably, the relief layer includes an aperture and the support layer includes an aperture, the apertures are in fluid communication.

Preferably, the mattress structure includes one or more comfort layer, the comfort layer is placed above the relief layer for concealing unevenness of the relief units and to form an even surface, the comfort layer includes an aperture which is in fluid communication with the apertures in the relief layer and support layer.

Preferably, the chassis includes an air permeable structure which is in fluid communication with the apertures in the relief layer, support layer and the comfort layer.

Preferably, the mattress further comprises at least one comfort layer and one or more supplementary support unit which is placed between the relief layer and the comfort layer.

Preferably, the two of the relief units are main relief units, the two main relief units provide greater relief ability than the other relief unit and the supplementary support unit is placed between the two main relief units.

In another aspect of the invention there is provided a method making use of the characteristics of the mattress structure for allowing a user to understand usage of the mattress structure and to make a decision on the suitability of the mattress structure, the method comprising the following steps:

(i) providing a sample mattress structure by the seller, the sample mattress structure comprising a relief layer, the relief layer comprising two or more disassemble-able relief units, the relief layer being dividable into two or more relief zones, these relief zones being defined corresponding to the position of various parts of the user body, at least one or more of the relief zones being formed by relief units of different sizes, at least one of the relief units being a main relief unit which provides greater relief ability compared to that of the other relief units, the relief units in the relief zones being interchangeable in position to change the relative positions of the relief units in the zone to accommodate different body heights and lengths of various body parts of different users or different body conditions;

(ii) testing the sample by the user, understanding use of the mattress structure and deciding suitability of the mattress structure by the user, in that the user may change the position of the main relief unit relative to the other relief units in the mattress structure according to personal needs for testing the sample mattress structure; and (iii) providing a brand new mattress structure in exchange for the sample mattress structure by the seller when the user has familiarized with the use of the mattress structure and decided the mattress structure to be suitable.

Preferably, the method further includes a chassis for accommodating at least two relief units in the relief layer, to delimit relative position of the relief units.

Preferably, the user is required to take away the sample mattress structure and test the sample mattress structure within a specified period of time for understanding the use of the mattress structure and deciding the suitability of the mattress structure.

Preferably, the user is required to pay a deposited or a full price of a mattress structure before the sample is provided for testing.

Preferably, step (iii) may be replaced by step (iiib), step (iiib) involves the step of providing products of same value as the mattress structure for substituting the sample mattress structure.

Preferably, the method further comprises step (ia) before step (i), step (ia) comprises the step of providing a detection device for detecting sequence of the relief units and the position of the main relief unit relative to that of the other relief units that are suitable for the user.

Preferably, the step (ia) further includes the step of providing a specification of a personalized arrangement for the user.

Preferably, size of the sample mattress structure is different from that of a brand new mattress structure.

BRIEF DESCRIPTION OF DRAWING FIGURES

Figure 2:
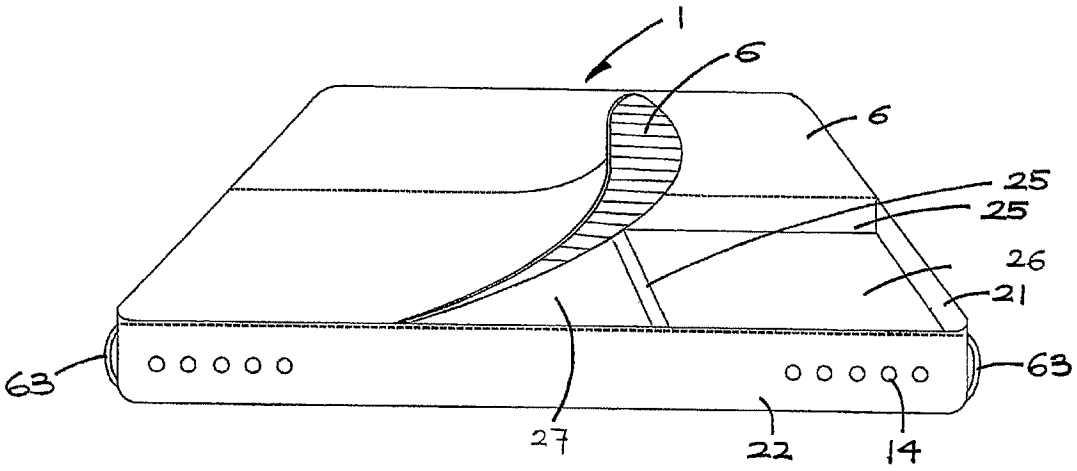
Figure 3:
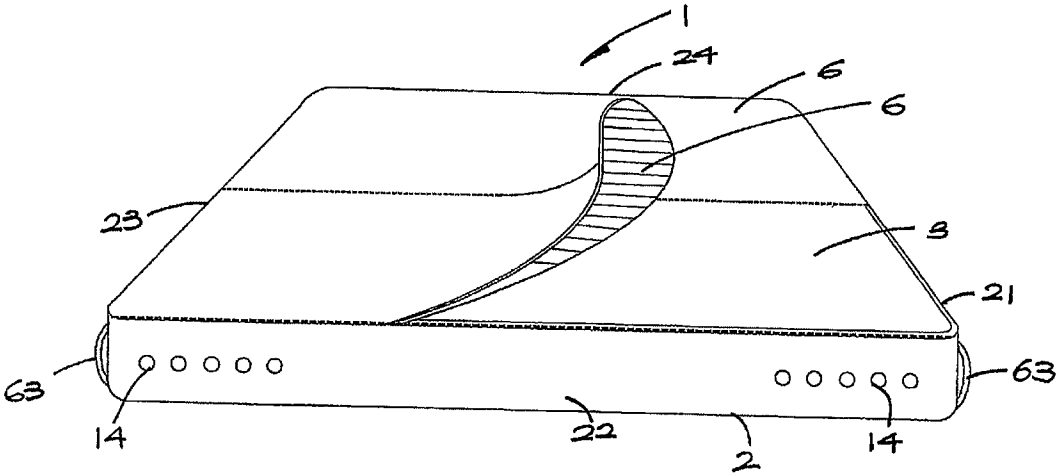
Figures 4A, 4B:
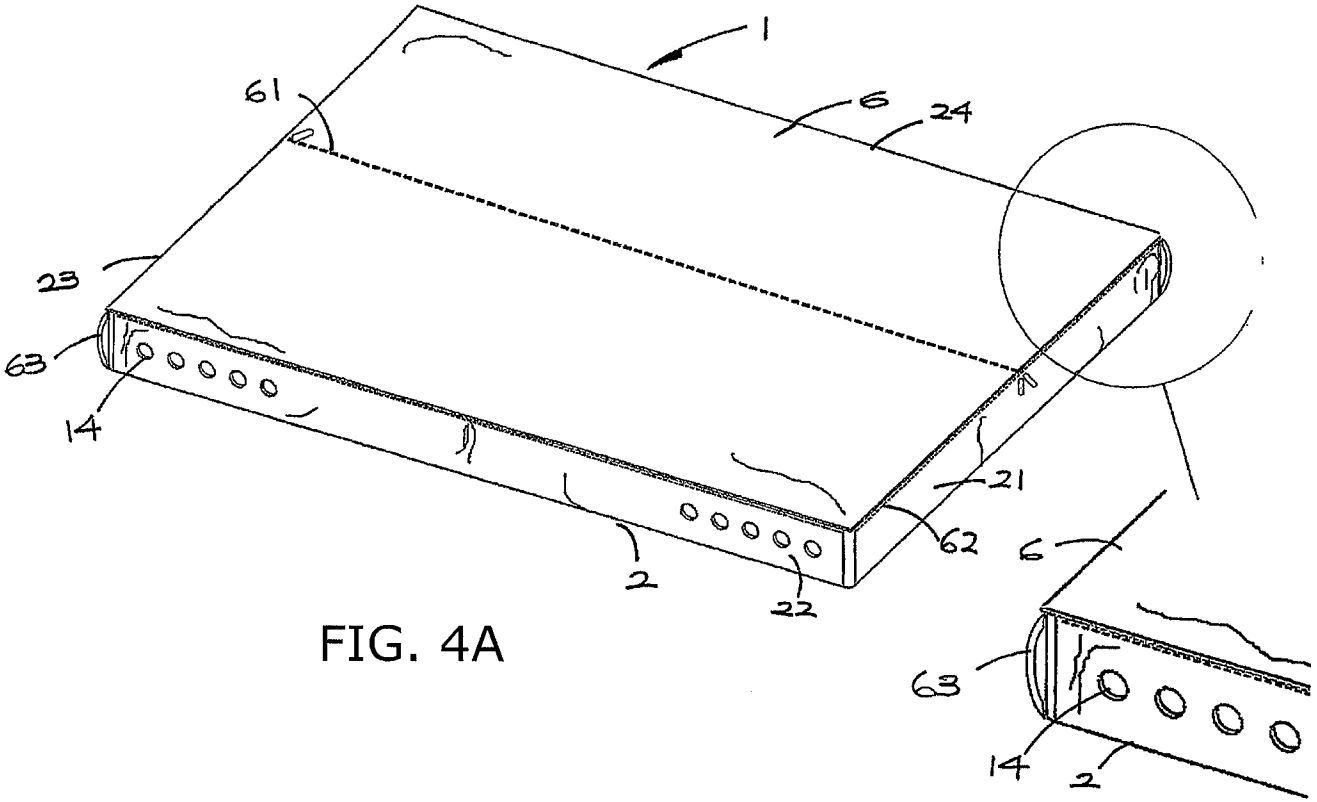
Figure 5:
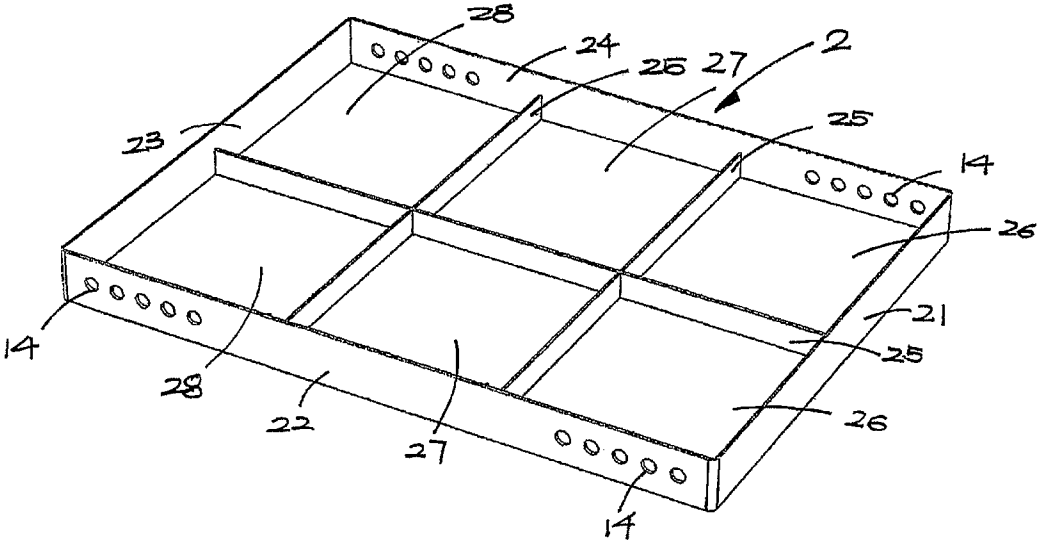
Figure 6:
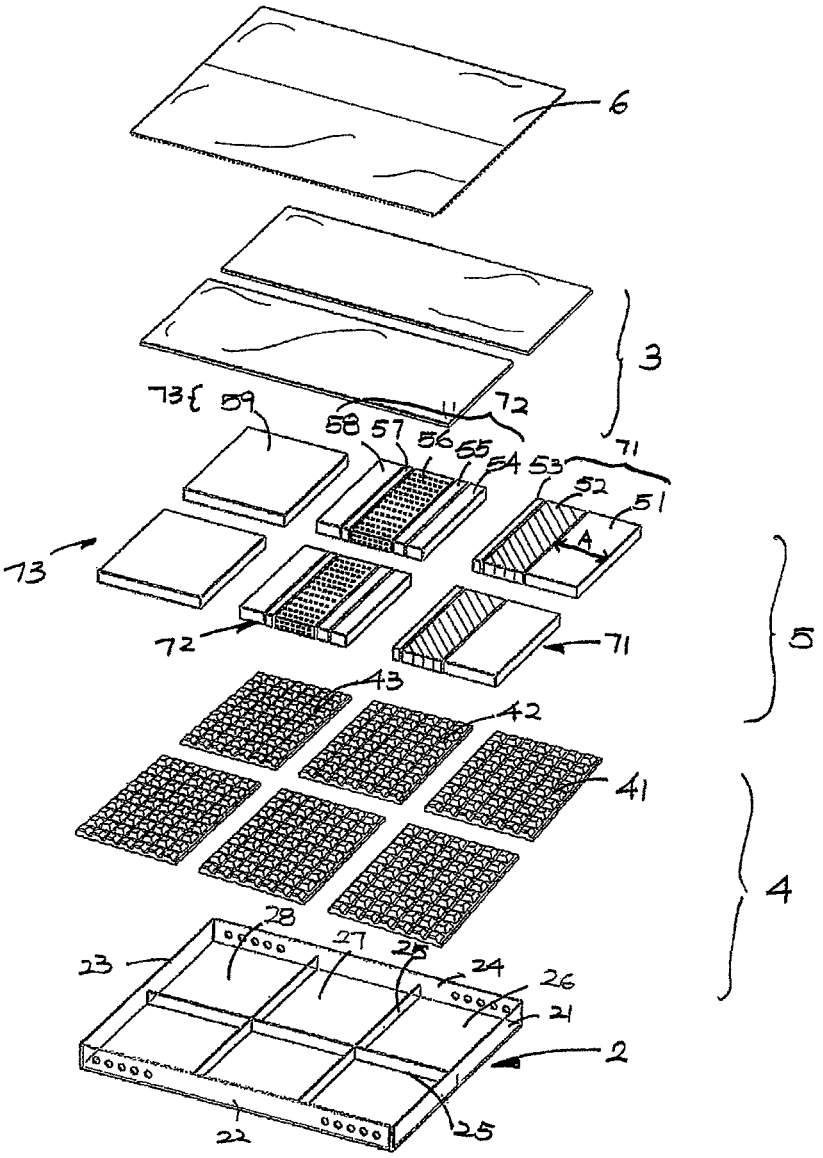
Figure 7:
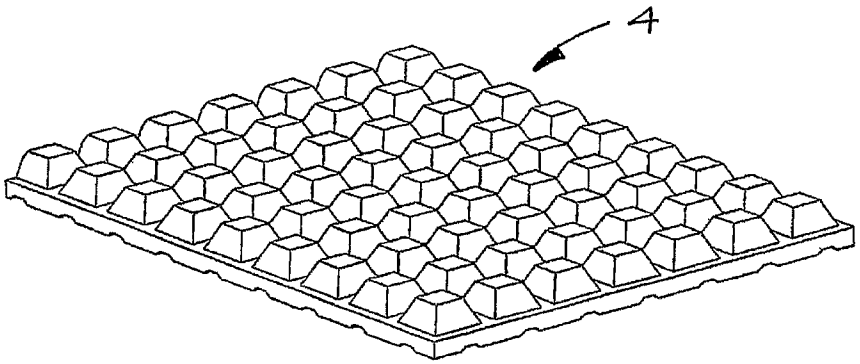
Figure 8:
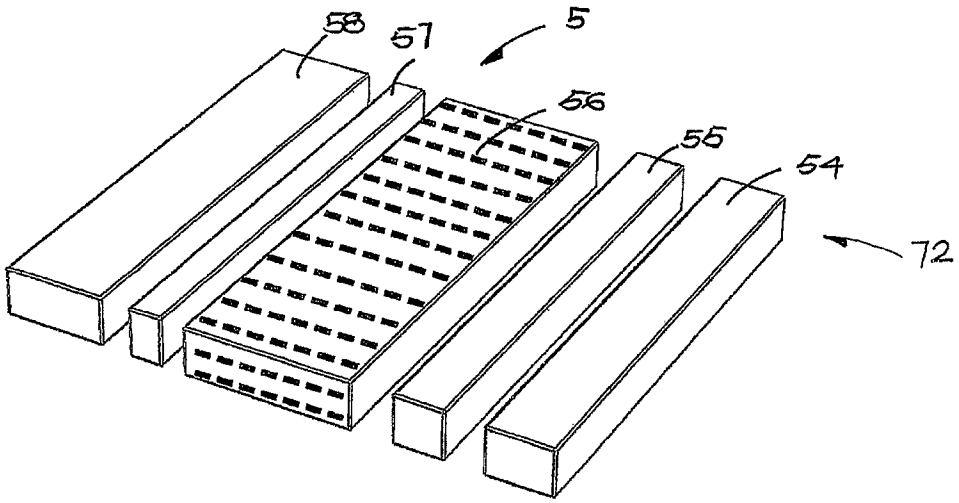
Figure 9:
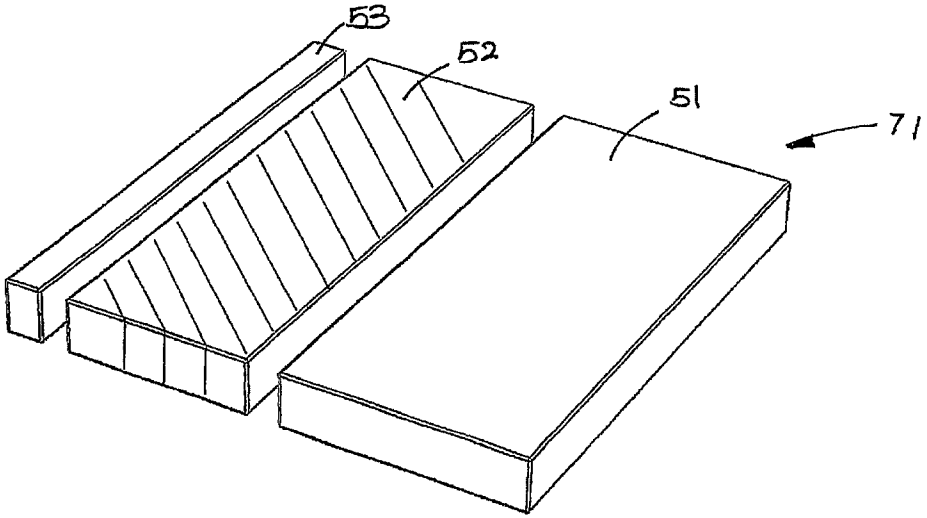
Figure 10:
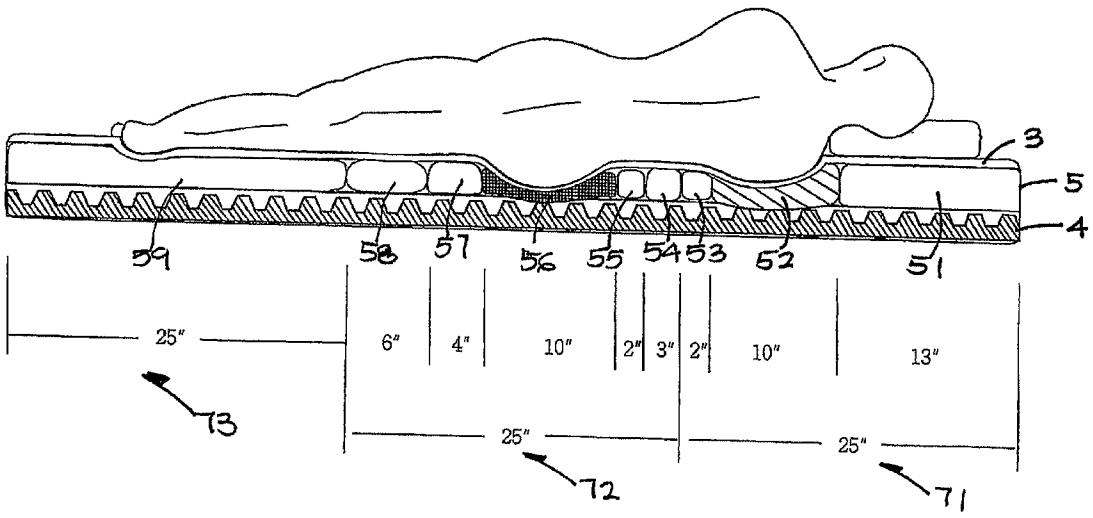
Figure 11:
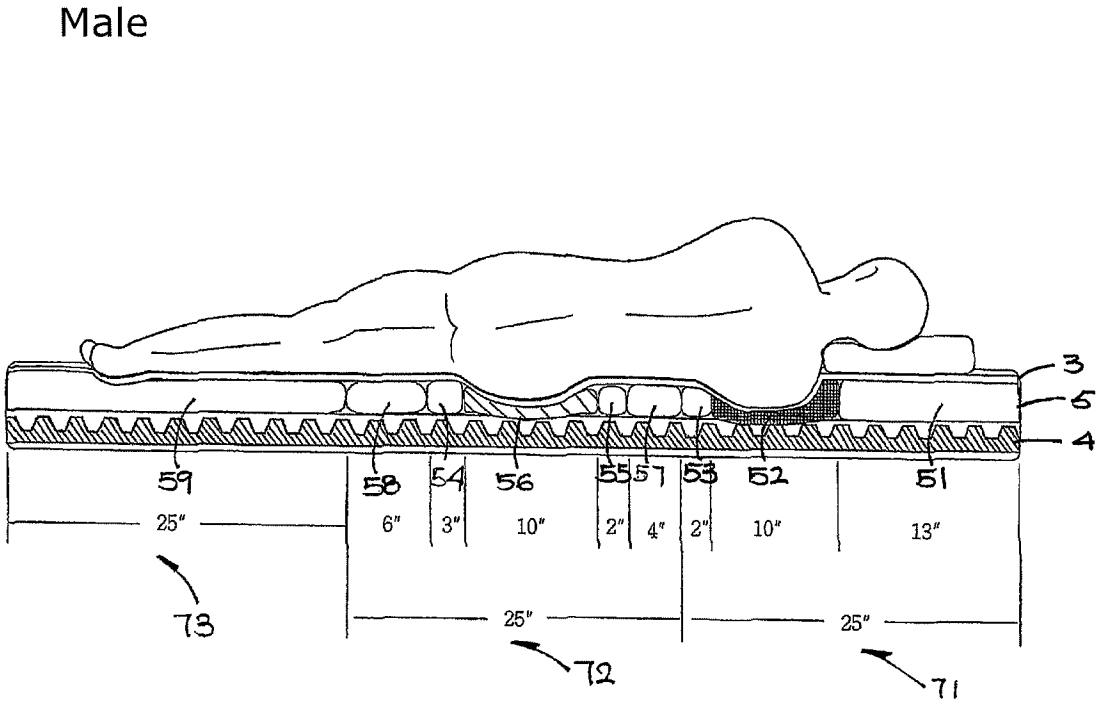
Figure 12:
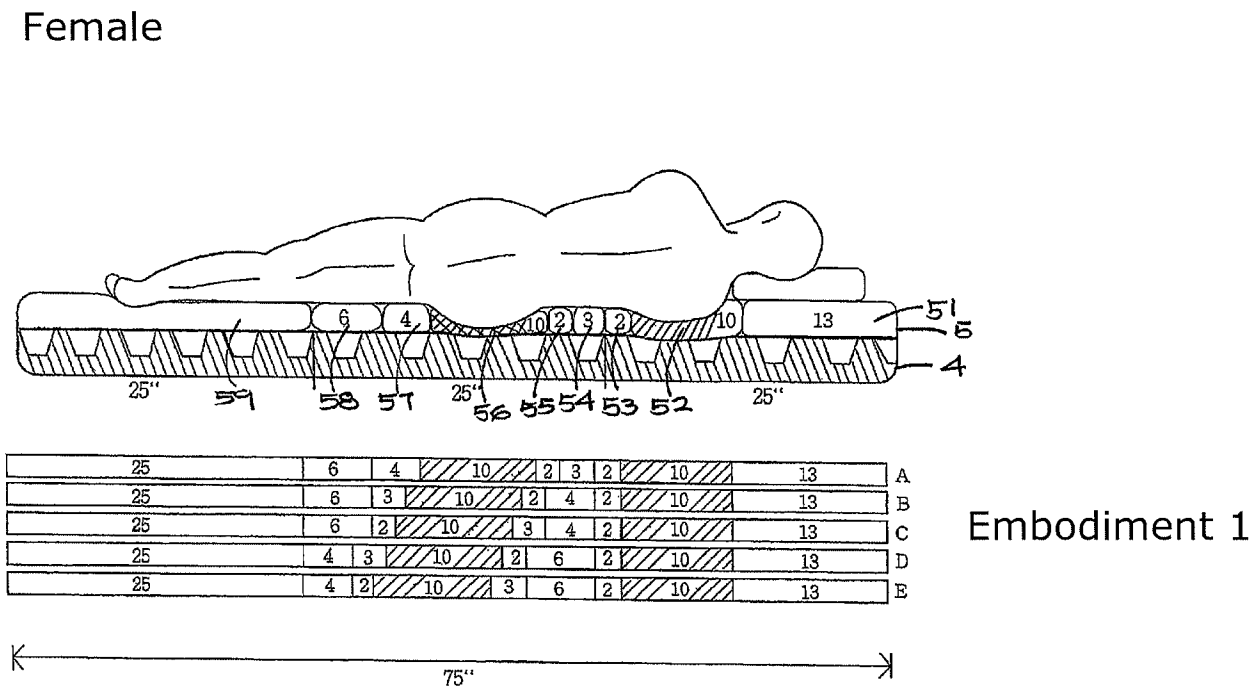
Figures 14A, 14B, 14C, 14D:
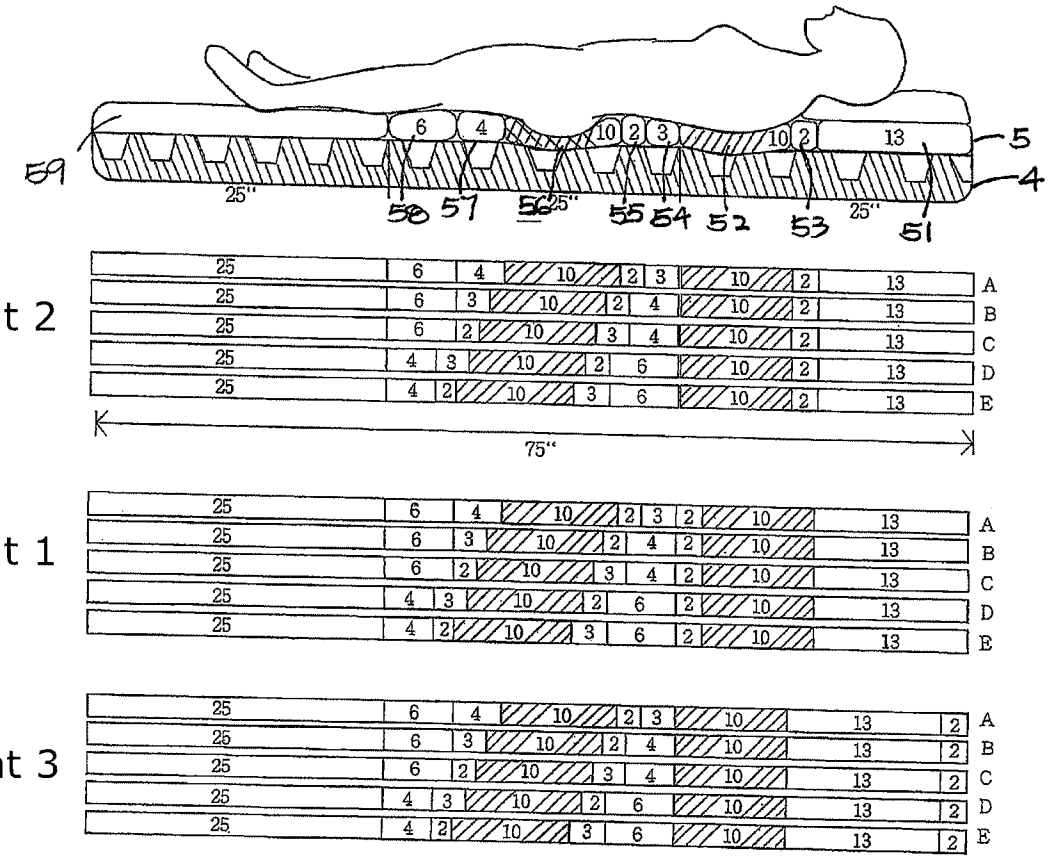
Figure 15:
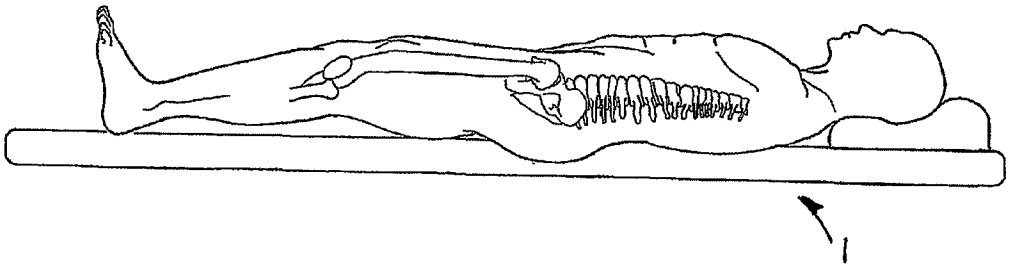
Figure 16A:
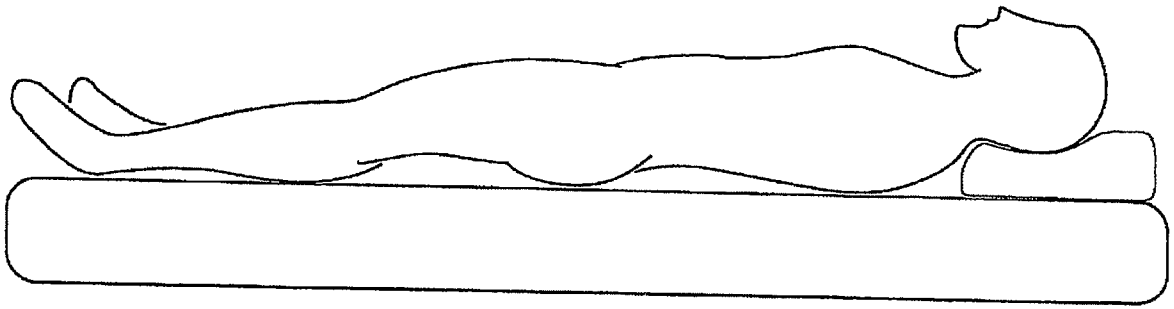
Figure 16B:
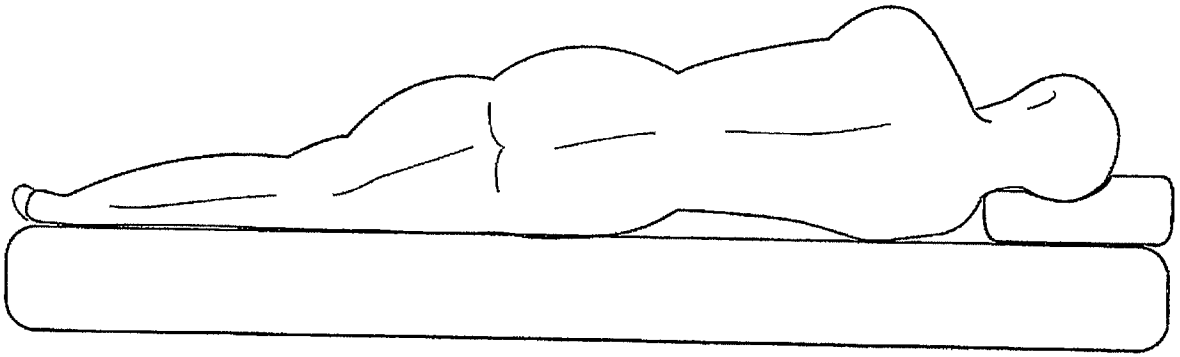
Figure 17:
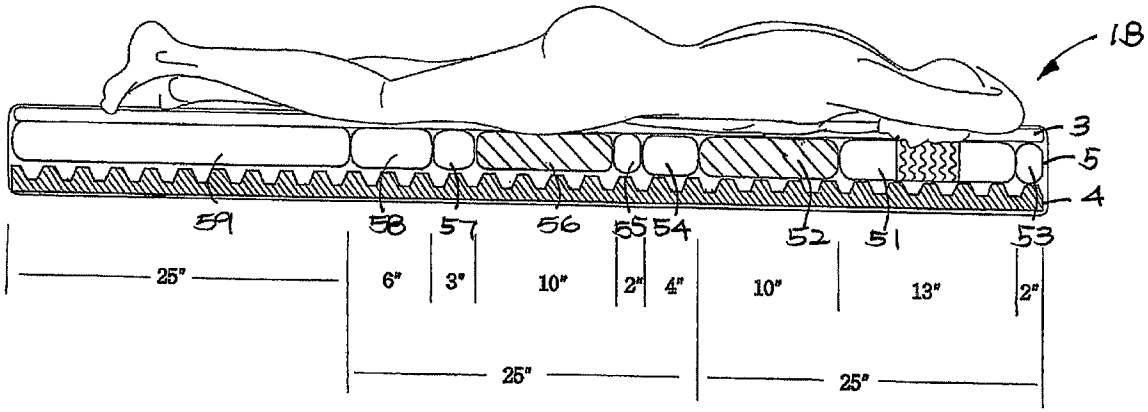
Figure 18:
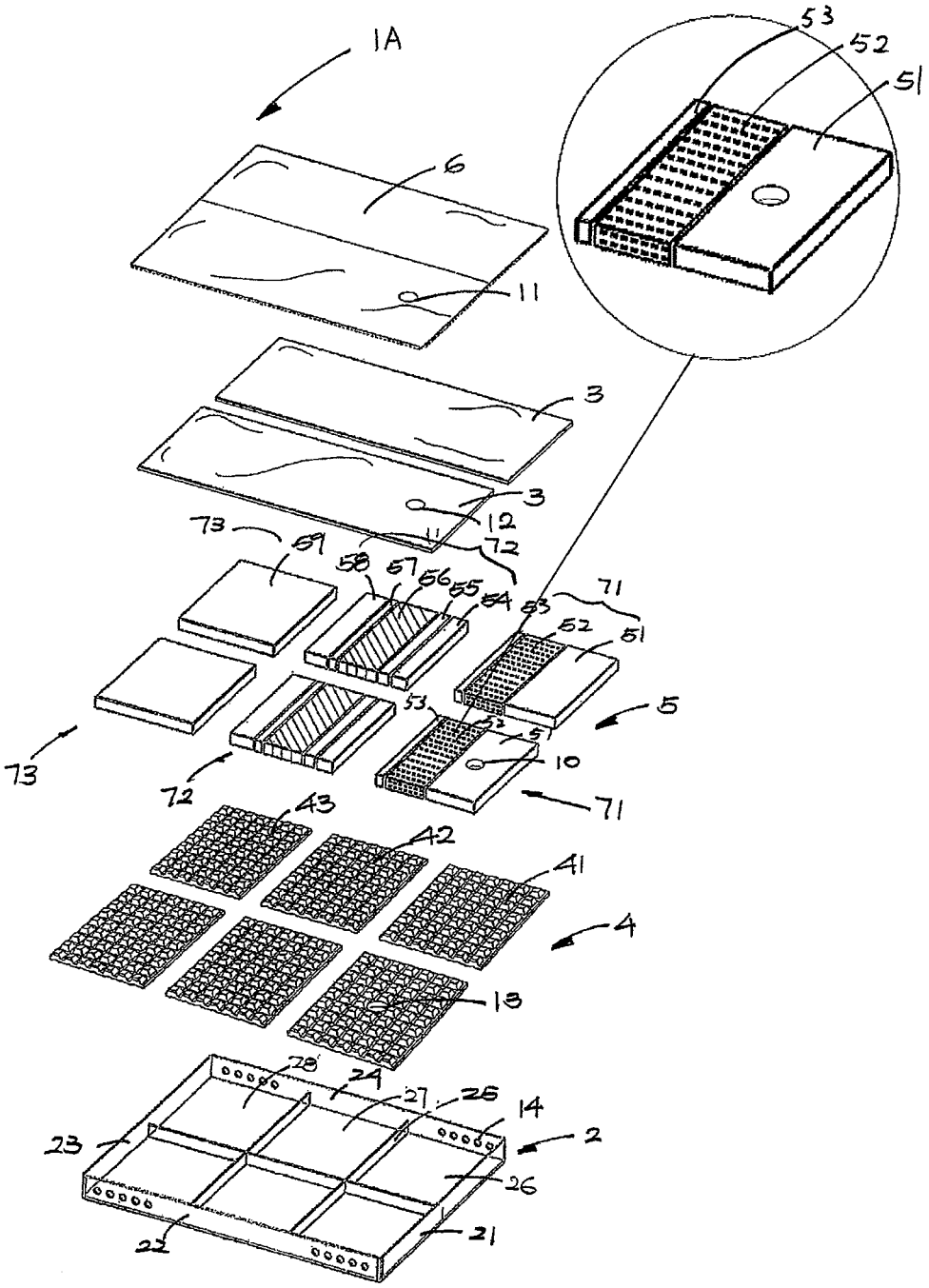
Figure 19:
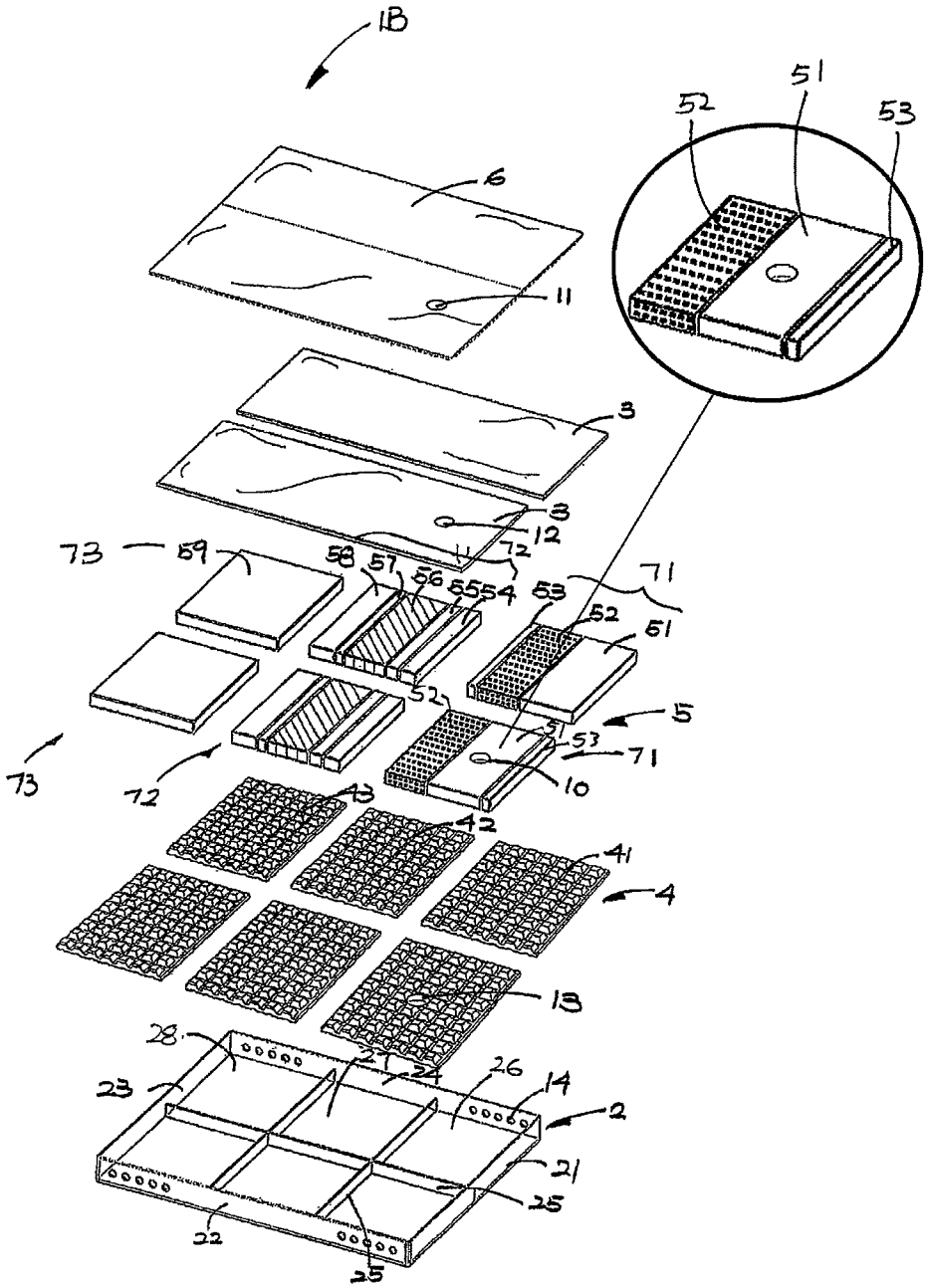
Figure 20B:
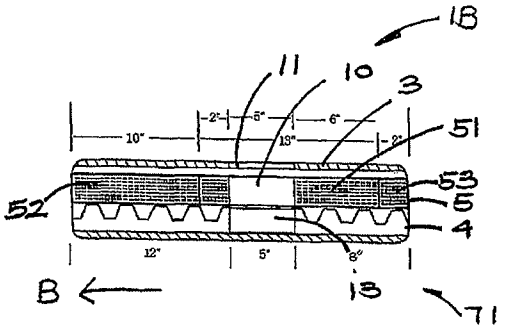
Figure 20A:
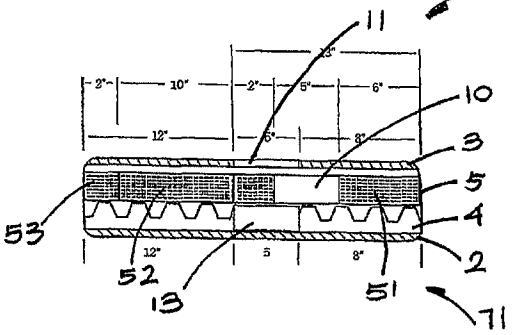
Figure 20F:
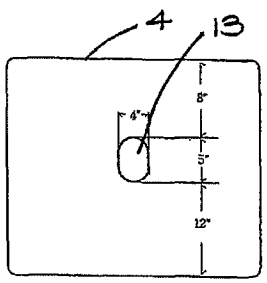
Figure 20E:
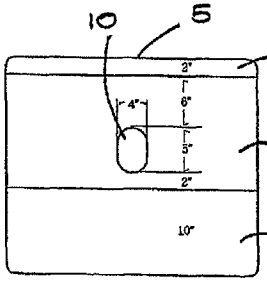
Figure 20D:
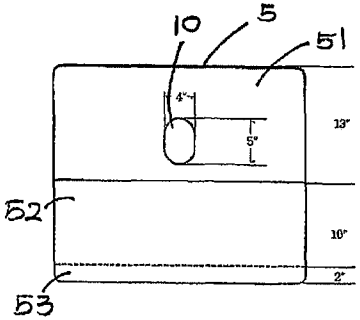
Figure 20C:
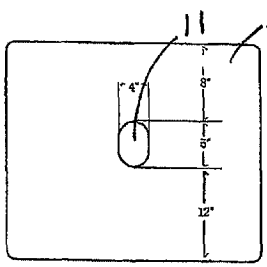
Figure 21:
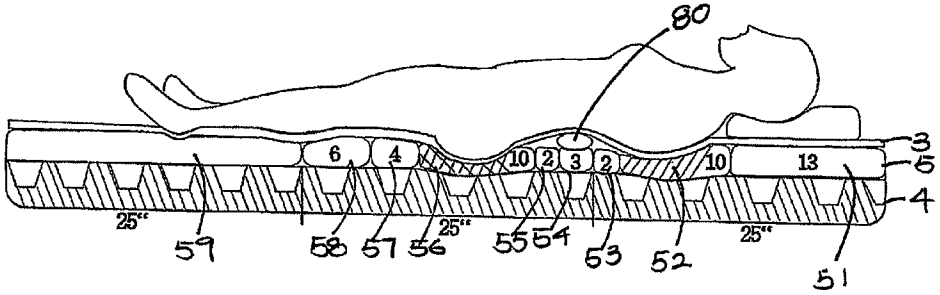
Figure 22:
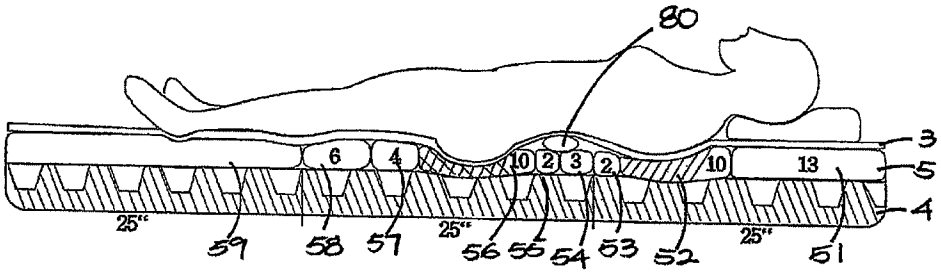
Figure 23:
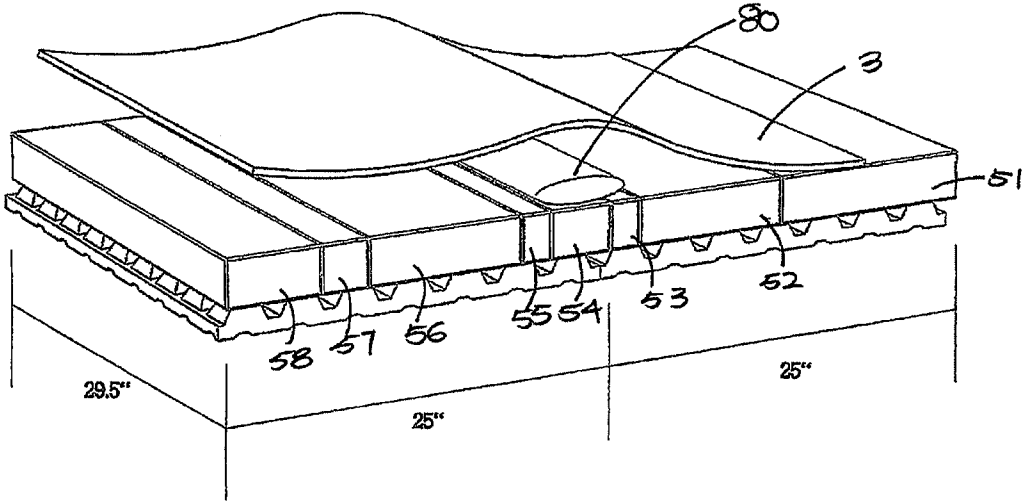
Figure 24B:
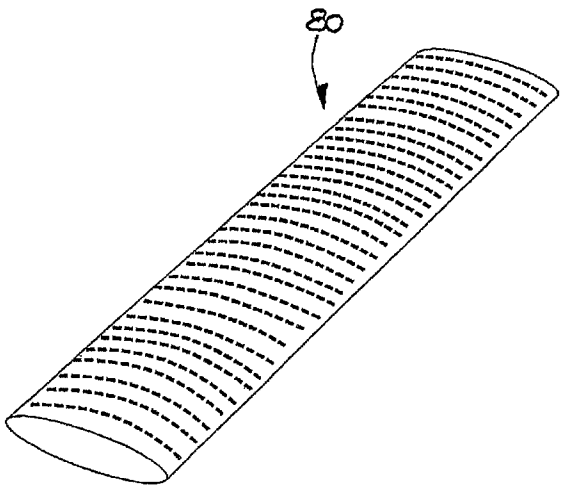
Figure 24A:
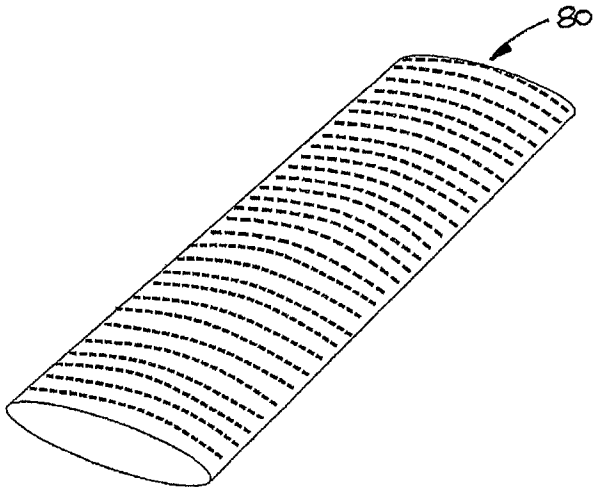

In the following, embodiments are described, by way of example only, with reference to the accompanying drawings in which:

FIG. 1A shows a perspective view of a mattress structure in accordance with an embodiment of the present invention, FIG. 1B shows an enlarged view of a connector of the mattress structure as shown in FIG. 1A, FIG. 2 shows a perspective view of a partly opened mattress cover of the mattress structure as shown in FIG. 1A, FIG. 3 shows a perspective view of a partly opened mattress cover of the mattress structure as shown in FIG. 1A, FIG. 4A shows a perspective view of the mattress structure as shown in FIG. 1A, FIG. 4B shows an enlarged view of a part of the mattress structure as shown in FIG. 4B, FIG. 5 shows a perspective view of a chassis of the mattress structure as shown in FIG. 1A, FIG. 6 shows an exploded view of the mattress structure as shown in FIG. 1A, FIG. 7 shows a schematic drawing of a part of a support layer in the mattress structure as shown in FIG. 1A, FIG. 8 shows a schematic drawing of a portion of a relief layer in the mattress structure as shown in FIG. 1A, FIG. 9 shows a schematic drawing of a portion of the relief layer in the mattress structure as shown in FIG. 1A, FIG. 10 shows a cross-sectional view of the mattress structure as shown in FIG. 1A, including a relief layer for the use of a female user, FIG. 11 shows a cross-sectional view of the mattress structure as shown in FIG. 1A, including a relief layer for the use of a male user, FIG. 12 shows a cross-sectional view of the mattress structure as shown in FIG. 10, including a relief layer for the use of a female user, the relief units in the relief layer may be in different arrangements, FIG. 13 shows a cross-sectional view of the mattress structure as shown in FIG. 11, including a relief layer for the use of a male user, the relief units in the relief layer may be in different arrangements, FIGS. 14A to 14D shows a cross-sectional view of the mattress structure as shown in FIG. 10, including a relief layer for use of a female, the relief units in the relief layer may be in different arrangements, FIG. 15 shows a schematic drawing of the mattress structure as shown in FIG. 1A when in use, FIGS. 16A to 16B shows a common mattress when in use, FIG. 17 shows a schematic drawing of a mattress structure in accordance with a second embodiment of the present invention, FIG. 18 shows an exploded view of the mattress structure as shown in FIG. 17, FIG. 19 shows an exploded view of the mattress structure as shown in FIG. 17, in a different circumstance, FIG. 20A shows a cross-sectional view of relief units in a relief layer of the mattress structure as shown in FIG. 18, FIG. 20B shows a cross-section view of the relief units in the relief layer of the mattress structure as shown in FIG. 19, in a different circumstance, FIG. 20C shows a top plan view of an upper layer of the mattress structure as shown in FIG. 20B, FIG. 20D shows a top plan view of the relief layer of the mattress structure as shown in FIG. 20A, FIG. 20E shows a top plan view of the relief layer of the mattress structure as shown in FIG. 20B, FIG. 20F shows a top plan view of the upper layer of the mattress structure as shown in FIG. 20A, FIG. 21 shows a schematic drawing of the mattress structure in accordance with a further embodiment of the present invention, including a support pad, FIG. 22 shows the support pad positioned in a different position of the mattress structure as shown in FIG. 21, FIG. 23 shows a schematic drawing of a portion of the mattress structure as shown in FIG. 21, and FIGS. 24A and 24B shows an enlarged drawing of the support part as shown in FIG. 21.

DETAILED DESCRIPTION

While certain embodiments have been described, these embodiments have been presented by way of example only, and are not intended to limit the scope of the inventions. Indeed, the embodiments described herein may be embodied in a variety of other forms; furthermore, the invention may be implemented in other ways and other forms without departing from the spirit of the inventions.

The present mattress structure 1 is considered to be made up of two layers, from bottom to top, including a support layer 4 and a relief layer 5. In a different embodiment, the mattress structure includes a comfort layer 3. The comfort layer 3 may be divided into two pieces. Preferably the whole mattress structure 1 is enclosed or surrounded by a mattress cover 6 and a chassis 2. The comfort layer 3, the support layer 4 and the relief layer 5 are not in direct contact with the user to maintain cleanliness of the mattress structure 1. The mattress structure 1 may be use independently or with a conventional mattress. When the mattress structure 1 is used with a conventional mattress, the support layer 4 may be removed, only the relief layer 5 and the comfort layer 3 are placed on the conventional mattress.

The present mattress structure 1 may be a single mattress structure 1 or a double mattress structure 1. Preferably, the double mattress structure 1 is a combination of two single mattresses structure 1.

The chassis 2 is substantially rectangular, with a dimension similar to that of conventional mattresses. The chassis 2 may be a single chassis for use with a single mattress structure 1; or it may be a double chassis for use with a double mattress structure 1. The chassis 2 has four sides. Along each side there is provided an upwardly extending side wall 21, 22, 23 and 24. Each side wall 21, 22, 23 and 24 is connected to form a peripheral wall. In one embodiment, the peripheral wall 21, 22, 23 and 24 is of a height sufficient to cover at least part of a peripheral edge of the relief layer 5 or more. The peripheral wall 21, 22, 23 and 24 is useful in maintaining the relative positions of each support unit 41 to 43 in the support layer 4 and each relief unit 51 to 59 in the relief layer 5.

A space is defined within the peripheral wall. Preferably the chassis 2 includes a separation wall 25 which divides the space into two or more zones 26 to 28. Preferably, a single chassis 2 is divided into two or three chassis zones 26 to 28 and a double chassis 2 is divided into two sets of two to three zones 26 to 28. These chassis zones 26 to 28 maintain the relative position between the respective relief units 51 to 59 and hold them together. The height of the separation wall 25 may only be sufficient to reach the support units 41 to 43.

As shown in FIG. 1B, the bottom edge of the mattress cover 6 is connected to the top edge of the chassis 2 through a connector 62. The connector 62 may be a zipper. The mattress cover 6 and the chassis 2 may be formed by a material that is stretchable and/or resilient, including synthetic leather and non-woven fabric. At the top surface of the mattress cover 6 there is provided a connector 61 which may be in the form of a zipper. As shown in FIG. 2, the connectors 61 and 62 when released, at least a part of the mattress cover 6 is openable for reaching the comfort layer 3, the support layer 4 and the relief layer 5. This permits access for rearrangement of the comfort layer 3, the support layer 4 and the relief layer 5.

The mattress cover 6 has a corner or a pair of corners or all four corners provided with a handle 63. The handle 63 assists the user in moving the mattress structure 1 such that the changing of bed cover or linings would be relatively easy when comparing to mattresses without such a handle.

Preferably, the comfort layer 3 is made of latex or other resilient material such as memory foam. A comfort layer 3 for a double mattress structure may include two single comfort layers 3.

Conventional mattresses use metal spring as the internal support material. The mattress cannot be folded and is difficult to transport. It is also difficult to wash and allows bacteria and mites to accumulate. The metal spring deteriorates and may produce squeaky sound that disturbs the user. Even worse, the metal spring may pierce through and injure the user. The magnetic field generated by a metal spring may affect the brain waves of the user and adversely affect the quality of sleep.

The support layer 4 is made of resilient and soft material. Preferably, the support layer is a rectangular layer or it may be made up of two or four, three or six support units 41 to 43. The support units 41 to 43 are independent units. A single support layer 4 may include three support units 41 to 43, distributed sequentially along principal axis X of the mattress structure 1. A double support layer 4 may be made up of two single support layers 4 placed side-by-side. In one embodiment, each support unit 41 to 43 is contained separately in the three or six zones 26 to 28 of the chassis 2. These support units 41 to 43 are inter-changeable, inter-disassembleable, moveable relatively or inter-replaceable.

The relief layer 5 is moveable and changeable. Its main function is to relieve the pressure on the user. The relief layer 5 is formed from two or more independent relief units 51 to 59. These relief units 51 to 59 are inter-changeable, inter-disassembleable, moveable relatively or inter-replaceable and are contained in the chassis zones 26 to 28 above the support layer 4. In other words, the relative position of each relief unit 51 to 49 is changeable. Preferably, as shown in FIGS. 3 to 8, the relief layer 5 includes nine relief units 51 to 59. Each relief unit 51 to 59 has its pre-determined width A. The relief layer 5 is generally made up of three 25 inches long relief zones 51 to 53, 54 to 58 and 59. The relief zone 51 to 53, 54 to 58 and 59 correspond to the user's shoulders, hips and legs respectively.

The first zone 26/71, made up of relief units 51 to 53, corresponds to the head and shoulder of the user, The relief unit 51 is 13 inches wide, the relief unit 52 is 10 inches wide and relief unit 53 is 2 inches wide, provided for and corresponds in position to the head, shoulders and upper back of the user respectively to thereby relieve pressure on those part of body of the user. In this zone 26, there is provided a main relief unit position including a main relief unit 52. The position of the main relief unit is provided for and corresponds in position to the shoulders of the user. The main relief unit 52 has a relieve ability greater than that of the other relief units 51 and 53 in the same zone. Preferably, the main relief unit 52 is made of a material relatively softer than that of the main relief units 51 and 53. When the user is side-sleeping, as shown in FIGS. 4 and 6, the shoulders are wider than the head and the upper back, especially for man and need to take up more space. When the mattress structure 1 is used, the shape of the main relief unit 52 experience a greater change in shape when comparing to the other relief units 51 and 53 in the same zone, such that it provides a relatively greater relieve effect. The main relief unit 52 provides a relative more distinct relieve effect when comparing to the other relief units 51 and 53.

The second zone 27/72 is provided for and corresponds in position to the lower back, waist, hips and knees of the user. The second zone 27/72 is made up of five relief units 54 to 58. The arrangement of the relief units 54 to 58 in the zone is different for male and female as they usually have different body heights/lengths. As shown in FIG. 10, the relief unit 54 has a width of 3 inches, the relief unit 55 is 2 inches wide, the relief unit 56 is 10 inches wide, the relief unit 57 is 4 inches wide and the relief unit 58 has a width of 6 inches. For a female user the relief units 54 to 58 are arranged in order. For a male user, the arrangement of the relief units is different. The first relief unit 57 is followed by the relief units 55, 56, 54 and 58 sequentially. The relief units 54 to 58 are inter-changeable to switch between a relief layer 5 for female user and a relief layer 5 for male user.

In the second zone 27/72, the relief unit 56 has a width larger than that of the relief units 54, 55, 57 and 58. In this zone 27/72, there is a main relief position formed by the main relief unit 56. The main relief unit 56 is 10 inches wide, the relief unit 56 is provided for and corresponds in position to the hips of the user for providing a relatively greater relief effect comparing to that of the other relief units 54, 55, 57 and 58 in the same zone. The relief units 54 and 55 are provided for and correspond in position to the user's lower back and waist of the user. The relief units 57 and 58 are provided for and correspond in position to the thigh and knees of the user for relieving pressure in those regions.

The second zone 27/72 of a mattress structure 1 for female user has a main relief unit 56 with higher relief ability than that in the first zone 26/71. The hips and the pelvis of a female is usually most protruding than the shoulders. A higher relief ability main relief unit 56 is required to accommodate the hips and the pelvis.

For a male user, the first zone 26/71 in the mattress structure 1 has a main relief unit 52 with a higher relief ability than that in a second zone 27/72 because the shoulders of a male user is usually the widest part of the body and during side sleeping, a higher relief ability main relief unit 56 is required to accommodate the shoulders. As the widths of the main relief units 52 and 56 are both 10 inches, they are inter-changeable. In other words, a mattress structure 1 for female may readily be changed into a mattress for male and vice versa.

When lying flat, the most protruding part from behind of the body, no matter male or female, would be the hips. The main relief unit 56 is able to relieve the pressure on the hips and the spine of the user. As shown in FIGS. 16A and 16B, insufficient relieve of the pressure on the hips and spine would adversely affect the health of and becomes a burden to the spine of the user.

Conventional mattress does not involve a point-to-point pressure relieve structure. The shoulders and hips of the user would be under severe pressure. The cervical vertebra, thoracic vertebra and pelvis would not be in the same plane. This would affect the breathing and blood circulation of the user and in the long run, injure the cervical vertebra.

The overall arrangement of the relief units 51 to 59 and the positions of the main relief units 52 and 56 in the relief layer 5 are self-adjustable. To achieve targeted effective pressure relief, the main relief units 52 and 56 are inter-changeable and the relief units 51, 53 to 55 and 57 to 59 may also be inter-changeable. The relief abilities of the relief units 51 to 59 may be different, varying from mild, middle to strong. When the pressure on the pressure point of the user's body is sufficiently relieved, the fascia is allowed to relax, blood circulation is improved, minimizing the chance of paralysis, rheumatic pain and tiredness after sleep.

In the third zone 28/73 of the mattress structure 1, it targets to support the legs of the user, preferably the lower legs. The third zone 28/73 is made up of relief unit 59. As the pressure on the legs is comparatively more evenly distributed along their length, it is not necessary to separate the relief unit 59 into smaller targeted relief units. Depends on the user's preference, the relief unit 59 may be made of different materials with different support abilities. The relief unit 59 may be a main relief unit.

Preferably the relief abilities of the main relief units 52 and 56 are the same.

All relief units 51 to 59 can be independently removed, changed or replaced, such that when one of them worn out, it can be changed or replaced without needing to change or replace the other relief units.

To suit the body height and waist length of different users, in a different embodiment, as shown in FIGS. 12 and 13, the relief units 51 to 53 in the first zone are 13 inches, 10 inches and 2 inches wide respectively. The relief units 54 to 58 in the second zone are inter-changeable and may be of different arrangements. As shown in embodiment A, the relief units 54 to 58 are arranged in order for users with a waist length of 5 inches. As shown in embodiment B, the relief units are arranged in the order of 57, 55, 56, 54 and 58 for users with a waist length of 6 inches (i.e., 5+1 inches). As shown in embodiment C, the relief units are arranged in the order of 57, 54, 56, 55 and 58 for users with a waist length of 7 inches (i.e., 5+1+1 inches). As shown in embodiment D, the relief units are arranged in the order of 58, 55, 56, 54 and 57 for users with a waist length of 8 inches (i.e., 5+1+1+1 inches). As shown in embodiment E the relief units are arranged in the order of 58, 54, 56, 55 and 57 for users with a waist length of 9 inches (i.e., 5+1+1+1+1 inches).

In another embodiment as shown in FIGS. 14A to 14D, the relief units 51 to 53 in the first zone are inter-changeable with different arrangements. As shown in the version 1 of the embodiment, the relief units 51 to 53 are arranged in order which is suitable for use with a relatively narrower pillow. In the version 2 of the embodiment, the relief units are in the arrangement of 51, 53 and 52 which is suitable for use with a relatively wider pillow, as compared with that in version 1, and this should be suitable for the European market where relatively wider pillows are used in general. As shown in the version 3, the relief units are in the arrangement of 53, 51 and 52.

The different embodiments and the different versions provide a large number of combinations to suit and accommodate the needs of users with different body heights/lengths.

The present invention serves as a complete resolution to the deficiencies of all closed unitary coil mattresses in the present market (as mentioned above in detail). Significant improvements are made in regard to hygiene, safety, convenience, health, environmental friendliness and comfort, particularly achieving superior functional breakthrough in spinal care. The ultimate goal for the invention as a whole is to let the weight of the sleeping body be genuinely and evenly relieved and supported. Achieving such goal is the key to longevity of mankind.

The S-shaped structure of the human spine and its vertical attitude when in motion contribute to two relatively fragile sections on the spine: the cervical vertebrae and the lumbar vertebrae, particularly in the low back. While the former sustains only the weight of the head, the latter supports the whole upper body including the head, and at the same time endures lateral swinging, running and jumping, carrying and lifting, forward and backward, and other physically challenging and demanding motions. It is thus easy to envision the lumbar vertebrae being the most labored and burdened section of the spine. Yet, they are also frequently forgotten or overlooked during sleeps.

The new invention is targeted at the above to cleverly and inventively design three groups of "moveable, changeable core pressure relief layer" (known as the relief layer), one group is for accommodating the head and shoulders, known as the "head and shoulders relief layer" in the first zone 71; another group is for accommodating the waist and hips, known as the "waist and hips relief layer" in the second zone 72. Preferably the Leg relief layer in the third zone 73 is a single unit and does not include moveable or changeable combination.

Within a relief zone 71, 72 or 73, the relevant relief units 51 to 59 include a main relief unit with a size along the principal axis of the mattress structure 1 designed to permit adjustment of its position along the principal axis in unit length when the position of the main relief unit is interchanged with that of the other relief units in the same zone. Preferably each unit length is one inch.

Each relief layer 5 has two or more thickness (or height), for example 3 inches or 4 inches. In the first and second zones 71 and 72, each made up of two or more pieces of materials with different relief abilities. The two combinations are results of the long term investigation, detailed analysis and calculations. For example, the first zone 71 is made up of three pieces of material each having a width of 2 inches, 10 inches and 13 inches respectively, the second zone 72 is made up of five pieces of material each having a width of 2 inches, 3 inches, 4 inches, 6 inches and 10 inches. This permits at least five different combinations and each being of one inch difference between the two main relief units 52 and 56. In other words, it can be made to accommodate users with the waist length difference of at least 5 inches. The waist takes up about ⅓ of the whole body length. The mattress structure 1 can be made to accommodate users with an overall body height/length difference of 1 to 15 inches.

Material with the same density but different surface areas or widths will exhibit different hardness/softness effects. In general, with a larger area it is harder, and with a smaller area it is softer. This accords with the laws of physics and nature. The two groups of relief layers are arranged according to these laws. Those of a smaller area (narrower width) are preferably placed adjacent the soft material, and so forth, to provide a smooth transition between soft and hard support.

A double mattress structure 1 is good at accommodating the difference in physiques between husbands and wives. Firstly the mattress structure 1 can be divided into two left and right sides so that husband and wife each have his/her own kingdom. The waist and hip relief layer can be arranged according to needs and so is the hardness/softness. In one embodiment, the mattress structure 1 is made up of at least three layers of different materials, different density with different functions placed one above the other. The lowest is the support layer 4 which may come in with two or more softness/hardness. The middle layer is the relief layer 5 which may come in with different thicknesses, 3 inches or 4 inches and each thickness may come in with two or more relief abilities. The uppermost layer is the comfort layer 3 which may come in with two or more degrees of hardness/softness. The three layers permit at least 16 combinations of mattresses with different softness/hardness. This allows users to easily pick a suitable mattress structure. The main function of the mattress structure is to support the various parts of the body and the best method of supporting is to relief and disperses pressure.

The main advantage of the mattress structure 1 is its flexibility. From the perspective of a double bed, the mattress structure 1 is divided into left and right independent sides. The user of one side can select and adjust his/her side of the mattress structure 1 according to physique, sleeping habits and preferences to customize that side of the mattress structure which provides an optimal softness/harness and degree of relief. At the same time minimize the interference between the two persons and establish a common yet independent sleeping space.

On a personal level, in addition to supporting the main pressure points, namely the shoulders and hips, the mattress structure 1 caters for needs brought about by physical changes. We already know that the shoulder bones and the pelvis are the main zones that need pressure relieve. This is relatively easy to understand but many do not realize that these needs change continuously according to the body condition, age, habits or work patterns of the user.

For example, for a pregnant woman, during pregnancy, the baby's weight, the additional burden to the mother's waist and the cramping on the legs changes the needs of female user towards a mattress structure. When the waist needs special support, on one hand there is a need for harder material to support the bones in the waist and on the other hand the need of a more comfortable and softer material to relax the fascia. When the leg of the user cramps, the leg support zone of the mattress structure 1 can be heightened to lift the legs slightly higher for improving blood circulation and soothing the cramp.

Another example would be back pain and shoulder pain resulting from short term violent exercise or from a change in the work pattern such as typing. The user may change the pressure relief material of the mattress structure 1 according to needs. The features of diversification and multi-combination satisfy needs of different users in different stages of his/her life. This most simple and universal design provides a support portfolio which is easiest to change, adjust and alter. The invention make the mattress structure 1 easy to manipulate and very personal. In one embodiment, the top layer of the mattress structure 1 is transparent or translucent which allows the consultant to study the main pressure points of the customer for creating a personalized mattress structure 1.

A conventional mattress is heavy and clumsy. It takes a lot of effort and strength to change the bed sheets and covers. Also it is common practice to periodically turn over the mattress to avoid physical strain on certain parts of the mattress. People may be injured trying to change the bed sheets or to turn the mattress over. It is a waste of energy. This mattress structure 1 is made up of pieces and can easily be disassembled for transport. It is light and convenient to carry.

If some of the main relief zones or units are strained due to long term usage, that zone or unit can be readily replaced without too much effort, not like a conventional spring mattress. If a mattress is disposed because a small part of it is strained or depressed, this creates a massive waste and against the economic principle. The mattress structure 1 is very environmental unfriendly. The mattress structure 1 is made up of small and light units which allow the user to easily and effortlessly adjust or DIY the mattress structure according to needs. It is easy even to adjust the mattress structure daily.

There are mattresses filled with wasted material in the market and it is impossible to open the mattress for checking. People usually spend ⅓ of his/her time in bed and the hygiene of the mattress is important. The mattress itself is a hotbed of mites and bacteria. A mattress can be used for decades. In other words, the user is spending a lot of time with the mites and bacteria.

In view of the above problems, this mattress structure 1 is an open design which solves all the aforementioned problems. Firstly the mattress structure 1 is openable and each part is readily freely arrangeable by the user. The structure of the mattress is clear. The mattress structure 1 allows the user to see the inside of it and to arrange it according to physiques and sleeping habits, self-adjusting the main relief ability and the arrangement of the units, move up or down the relief units and may select material of different thickness, independently change or replace any one of the relief units. This is in line with the environmental friendly sprit.

As the mattress structure 1 is an open mattress, user may add on different accessories to improve comfort and increase the effect of the system. For example in winter a heated mattress may be inserted and in summer a cooled mattress may be inserted or even a massaging mattress may be added.

The relief layer 5 can be disassembled. Customer or user may purchase the relief layer 5 independently and may flexibly place the relief layer 5 on any conventional mattress to strengthen the pressure relief ability of the conventional mattress. The relief layer 5 may then form a corrective system for conventional mattress.

The internal components of this mattress structure 1 may be moved around and tailored to the body shape of the individual, thanks to the two high-end core pressure relievers for the shoulders and hip. As the positions of shoulders and hip would not be the same for people with different body shapes, customers with a larger body or special body shape such as one with kyphosis may move around the internal components to tailor to their needs.

Not only does the invention of this mattress structure 1 improve sleep quality, but also the quality and comfort of life, owing to its lightweight and convenience, sanitation and safety as well as material saving property, therefore effectively and sustainably balancing the eco-environment.

Years of studies by sleep experts discovered that even though the majority of people prefer sleeping on their back or side, a small number of them prefer sleeping on their stomach. In addition, many people of the present day hire masseurs for massage or physiotherapy at home, leading the need to lie often on their stomach. Unless an additional massage table is used at home, lying on the stomach may lead to bending of the neck, hindering smooth breathing and adversely causing strain to the neck and shoulders. There is however no mattress that can satisfy the special needs of these people, while this breakthrough invention can even cater for such minority of people.

In a different embodiment, the mattress structure 1 may be a changeable mattress structure 1A or 1B. The mattress structure 1A can be changed from a mattress structure to a massage mattress structure 1B. As shown in FIGS. 17 to 20F, the mattress structure 1A/1B includes a relief layer, a support layer 4, a comfort later 3, a chassis 2 and a cover 6. These parts are arranged in a similar way as in mattress structure 1. Mattress structure 1A/1B is different from mattress structure 1 mainly at the first zone 71 in the relief layer 5. The first zone 71 of the relief layer 5 of mattress structure 1A/1B has three relief units 51, 52 and 53 of a width 13, 10 and 2 inches respectively. The relief unit 51 also includes an aperture 10 for accommodating the face of a user. This aperture 10 can be aligned with an aperture 11 on the cover 6, an aperture 12 on the comfort layer 3 and an aperture 13 on the support layer 4 such that the user's face does not need to directly press against the cover 6 and the relief layer 5 which would affect breathing.

When the mattress structure 1A is used as a mattress for sleep, as shown in FIGS. 18 and 20A, the relief layer 5 is formed from the relief units 51 52 and 53 arranged in order. The aperture 10 may be filled with a filling. The aperture 11 on the cover, the aperture 10 on the relief unit 51, the aperture 13 on the support layer 4 and the aperture 12 on the comfort layer 3 are not aligned. As shown in FIGS. 20C and 20F, the apertures 12 and 13 are provided on the comfort layer 3 and support layer 4 respectively and are both 8 inches away from a front edge.

The chassis 2 includes air permeable aperture structure 14 which is in fluid communication with the aperture in the relief layer 5, the support layer 4 and the cushioning layer/comfort layer respectively.

The present invention is able to accommodate people of different preferences including sleeping on the side or on the back and firmness, as well as of different body builds and heights. The invention even caters for the minority who are used to sleeping on their stomach. Simply swapping some of the components in the first zone 71 creates a breathing hole for sleeping on the stomach. Therefore, people sleeping on their stomach no longer need to bend their cervical vertebrae, greatly reducing injury thereof. This device also benefits people having massage at home, as lying on the stomach is more comfortable and preferred during massage. With this mattress of novelty, a bent neck is no longer a compromise. Similarly, this mattress is useful for populations preferring a larger pillow or a square pillow, such as people from Germany and France.

As shown in FIGS. 19, 20B, 20D and 20E, the mattress structure 1A may be changed or rearranged to form mattress structure 1B. A filling is removed from the aperture 10. The relief unit 53 of the relief layer 5 can be moved ahead of relief unit 51. The relief units 51 and 52 are arranged in order in the direction of the arrow B. A side of the relief unit 51 is parallel with a side of the mattress cover 6. At that time, the aperture 10 and apertures 11, 12 and 13 are aligned to form an air passage. When the user is in the prone position over the mattress structure 1B, the air passage allows the user to breath without needing to turn his/her neck. Preferably, the chassis 2 has an air permeable structure 14 on the sides 22 and 24 and together with the apertures 13, 12, 10 and 11 allow the user's face as well as the mattress structure 1B to be in air communication with the atmosphere. User may exhale through these holes 11, 10, 12 and 13 and the air permeable structure 14 to the atmosphere. Preferably, the air permeable structure includes one or more apertures.

As shown in FIGS. 22 to 24B, to suit the physique of the users of different ethnic and nationality, in another embodiment, as shown in FIGS. 21 to 24B, the mattress structure 1 further includes a supplementary support unit 80 which may also be known as "waist protecting pad". As shown in FIGS. 24A and 24B, the supplementary support unit 80 comes in with two or more sizes and for each size with two or more degrees of softness/hardness. The supplementary support unit 80 may be placed between the mattress structure 3 and the relief layer 5. As shown in FIGS. 21 to 23, the supplementary support unit 80 is placed directly on the relief units 54 and 55 or the relief unit 54. The supplementary support unit 80 together with the relief units 54 to 58 in the second zone 72 forms more than 100 different combinations for accommodating the physique of different people and provide more options.

The mattress of the present invention is used on a single side in a single orientation, requiring no laborious flipping. The comfort support of the mattress is two times to that of a "double sided mattress". With a thickness of 8", the mattress offers comfort similar to a double sided mattress of 16" in thickness. A double sided mattress requiring flipping has to incorporate a comfort layer on each side in its design, while unfortunately the user only uses one side at any one time, with the other side uselessly facing the bed frame. In contrast, the mattress of the present invention only has to be half the thickness of a double sided coil mattress in order to offer the same comfort. "Coilibre" (FIG. 7) formulated by the inventor is used in the mattress in place of metal coils. The Coilibre is highly resilient, stable and durable, without the issues of metal fatigue or creakiness or the risk of piercing and injuring the body. It is thus a capable candidate for the supportive layer.

The present invention is a breakthrough in terms of its openness. Being open means that the core material can be examined, providing peace of mind when sleeping. Further, the core material can be taken out for cleaning and sanitizing or deodorizing. Another benefit achieved by this kind of openness is the combination of health, comfort and environmental friendliness. The invention is the first mattress available for "separate sale": any part of the mattress structure 1, including supporters 41 to 43 and relievers 51 to 59, can be purchased and replaced separately. The open design of the mattress of the present invention offers convenience for the user to examine the usage of the mattress from time to time, as well as to adjust and arrange a combination suitable for their own body shape and height. When a certain part is damaged, the part in question can be repaired or replaced separately, without resorting to disposing of the whole mattress or withstanding undesirable support. Disposal of a mattress may be wastage and not environmentally friendly, yet withstanding undesirable support for a long term is unquestionably unhealthy. The choice between these two has been baffling a lot of people, yet will no longer be the case.

The comfort layer 3 and the mattress cover 6 can be removed from the relief layer 5, the support layer 4 and any conventional mattress for independent cleaning. Under different weather conditions, the comfort layer 3 or the mattress cover 6 made of a different material may be used. Under severe cold weather, one can use a bed cover of thicker material such as down, wool, or even fur. Under hot weather, the comfort layer 3 or the mattress cover 6 may be made of bamboo or vine knitted material or wood recycled fiber. The mattress 1 helps save energy and costs by requiring less air conditioning. It is comfortable and healthy to use and easy to clean as the mattress cover can be opened through a central zipper. Under the same temperature, the user, more afraid of cold, may retain the comfort layer 3 and the mattress cover 6 of thicker material and the other, more afraid of heat, may continue to use the more air permeable and cool material. Comfort layer 3 and mattress cover 6 made of different materials can be applied to the same mattress 1.

This newly invented LEGO type assembly is light to carry and easy to transport. This would avoid the need of arranging delivery resulting in waste time and resources.

The present invention is conceived with a great long-term vision to protect the spine of the human body as preparation for longer lifespan, as well as pragmatic missions at hand to improve sleep quality and thus work efficiency, reduce work injury during delivery and avoid bacterial and mite infections. With this invention, sanitation can be improved, and nasal and skin allergies be reduced. Delivery of the mattress is made easier and the user paying for the mattress is free from the labour of frequent flipping of the mattress. Another thoughtful quality of this invention is the novel "fashionability" of the face of the mattress, being changeable to match the current season. It is the first mattress available for separate sale in parts, thereby reducing wastage and carbon emissions. Serving the whole humanity and addressing major as well as minor issues, the mattress can be described as the invention of the century.

Another aspect of this invention is related to a method that makes use of the special property or feature of the mattress 1 to allow the user to understand and adapt to the use of and the mattress 1 per se. The mattress 1 includes a relief layer 5. The relief layer 5 is made up of two or more independent relief units 51 to 59. These relief units 51 to 59 are disassembled, inter-changeable or moveable. At least some of the relief units 51 to 59 are inter-changeable. The relief layer 5 can be divided into two or more relief zones and these zones are divided or assigned to accommodate various parts of the user's body. One of more of the relief zones is formed from two or more different sized relief units 51 to 59 and at least one of the relief units 51 to 59 is the main relief unit which provides relatively greater degree of relief comparing to the other relief units in the same zone. The relief units 51 to 59 within a relief zone are interchangeable to relocate or to change the relative position of the main relief unit within a zone for accommodating people with different heights, legs of different length etc. In accordance with the needs of a user, the relative position of the main relief unit in the relief zone can be changed for testing a sample of the mattress to further understand the use of the mattress 1. This also helps the user to determine whether the mattress 1 is suitable for him or her. As shown in FIGS. 12 and 13, the relief units 51 to 59 may have different widths. By interchanging or exchanging the relief units 51 to 59, the mattress 1 or the relief layer 5 may be made suitable for different users with different waist length or back length. As the relief units 51 to 59 are disassemblable, cleaning of the sample relief layer 5 is very convenient. It is also relatively easier to carry by the customer comparing to a conventional mattress. When one of the relief units worn out, it can be replaced independent from other relief units.

The aforementioned special features of the relief layer 5 allow the seller to offer samples for testing by customers. Customer may carry with them a sample or a sample may be delivered to the customer. The sample must be returned after testing for testing by other customers to minimize wastage. The seller is provided with a detection device to detect and identify the individual customer's need or preferred relief units 51 to 59 arrangement and position of the main relief unit 52 and 56 relative to the other relief units 51 to 59. The seller may then design a customized arrangement schedule for each customer and pre-arrange the relief units 51 to 59 according to the schedule for the customer before allowing the customer to take away a mattress. Even if the relative positions of the relief units 51 to 59 are disarranged, the user may follow the schedule to rearrange them accordingly. After testing, the customer will be well aware as to whether the relief layer 5 and the particular arrangement of the relief unit satisfy his/her needs. Testing also allow the customer to adapt. The customer may freely change or interchange the relative position of the relief units 51 to 59 in the sample until the relief layer 3 satisfies his/her needs. Preferably, the customer may take the sample back home and make use of the testing period, for example 10 days or two weeks, for thorough testing of the sample. Further, the seller may require the customer to prepay the price of a brand new relief layer 5 or pay a deposit and requires the customer to take away a sample for testing within a specified period of time. This is to ensure that the customer is able to test the sample without interruption. This will allow the customer to clearly understand his/her needs. If after testing, the customer still prefers to have his/her own relief layer 5, he or she can confirm at the selling point that he/she is able to adapt to the use of the product and may take away a brand new relief layer 5 which is prepaid for. Or the customer, when confirming at the selling point, may request the relief layer 5 to be delivered to a specific place e.g. home. If the customer decides not to continue with the use of the relief layer 5 after testing, the sample may be returned and the prepaid amount may be used in exchange for other products. That way, the customer will be clearly aware whether the product satisfies his or her needs and more importantly whether they are able to adapt to the use of such a relief layer 5. This also minimize wastage by avoiding the throwing away of an unsuitable mattress. This prevents the seller from repackaging the sample for selling as brand new products.

The returned relief layer and mattress cover are cleaned thoroughly. The cleaned, cleansed and sterilized relief layer and mattress cover can be used by another client for sample testing.

On the other hand, during customer testing, the seller may provide a cleanable and removable mattress cover for covering the sample relief layer. The seller may further provide a chassis 2 for fixing the relative positions of the relief units 51 to 59.

Preferably the sample of relief layer 5 is a compulsory step before purchasing a relief layer 5.

Preferably the sample relief layer has a size different from a conventional mattress. The sample has a length of 72 inches and a width of 30 inches to avoid confusion between the sample and the actual product and to avoid selling of the sample in lieu of the actual product.

Preferably, the sample relief layer is contained in a small box for ease of transport.

What is claimed is:

1. A mattress structure having a principal axis and comprising:

a relief layer including two main relief units, wherein each main relief unit corresponds to a hip and a shoulder of a user of the mattress structure; and a plurality of additional relief units, wherein at least one additional relief unit is positioned between the two main relief units, and a further additional relief unit positioned outside of and not between the two main relief units, wherein the two main relief units provide relatively greater pressure relief than the additional relief units of the mattress structure, each of the two main relief units has identical dimensions along the principal axis for interchange of the two main relief units in the mattress structure, at least one of the additional relief units has a dimension along the principal axis that is different from dimensions along the principal axis of other additional relief units, and positions of each of the additional relief units are individually adjustable along the principal axis with respect to the other additional relief units for changing distance between the two main relief units along the principal axis, so that the distance between the two main relief units, along the principal axis, is adjustable by a unit length to match distance between the shoulder and the hip of the user of the mattress structure.

2. The mattress structure as claimed in claim 1, including a conventional mattress, wherein the relief layer is located on the conventional mattress.

3. The mattress structure as claimed in claim 1, wherein the two main relief units have different pressure relief effects.

4. The mattress structure as claimed in claim 1, further comprising a comfort layer positioned on an upper surface of the relief layer to conceal irregularities of the upper surface.

5. The mattress structure as claimed in claim 1, wherein the relief layer is divided into at least two relief zones, each relief zone corresponds to a respective body part of the user, and each relief zone includes at least one of the main relief units or one of the additional relief units.

6. The mattress structure as claimed in claim 1, wherein the relief layer is divided into a shoulder relief zone for relieving pressure on a shoulder of the user, a hip relief zone for relieving pressure on a hip of the user, and a leg relief zone for relieving pressure on a leg of the user.

7. The mattress structure as claimed in claim 1, wherein respective additional relief units of the plurality of additional relief units have different softnesses for providing different pressure relief effects.

8. The mattress structure as claimed in claim 6, wherein each of the shoulder relief zone and the hip relief zone includes one of the main relief units.

9. The mattress structure as claimed in claim 8, wherein the main relief units in the shoulder relief zone and in the hip relief zone have different pressure relief effects and are interchangeable.

10. The mattress structure as claimed in claim 1, wherein respective additional relief units of the plurality of additional relief units have different densities producing different degrees of pressure relief effects.

11. The mattress structure as claimed in claim 10, further comprising a chassis accommodating the plurality of additional relief units.

12. The mattress structure as claimed in claim 11, wherein the chassis includes a wall having a height sufficient to overlap at least part of thicknesses of the plurality of additional relief units, transverse to the principal axis, for limiting relative positions of respective additional relief units of the plurality of additional relief units in the relief layer.

13. The mattress structure as claimed in claim 12, wherein the chassis is flexible.

14. The mattress structure as claimed in claim 13, wherein the chassis is divided into at least two chassis areas based on different body parts of the user of the mattress structure and corresponding to relief zones.

15. The mattress structure as claimed in claim 14, wherein
each chassis area contains at least two additional relief units of the plurality of additional relief units, and
all of each of the chassis areas is occupied, preventing relative movement between the at least two of the additional relief units.

16. The mattress structure as claimed in claim 14, wherein each of the chassis areas contains at least one support unit and three additional relief units of the plurality of additional relief units.

17. The mattress structure as claimed in claim 14, wherein each of the chassis areas contains at least one support unit and five additional relief units of the plurality of additional relief units.

18. The mattress structure as claimed in claim 1 further comprising a support layer, positioned on a side of the relief layer, opposite a side of the relief layer contacted by the user of the mattress structure, for supplementing the main relief units and the additional relief units in supporting the user, wherein
each of the relief layer and the support layer includes an aperture, and
the aperture in the support layer is in fluid communication with the aperture in the relief layer, forming an air passage.

19. The mattress structure as claimed in claim 18, wherein
the aperture in the support layer is positioned to correspond to a shoulder relief zone in the relief layer, and
the aperture of in the relief layer is located in an additional relief unit having a changeable relative position in the relief layer.

20. The mattress structure as claimed in claim 19, wherein
the mattress structure includes at least one comfort layer located on the relief layer and concealing unevenness between the additional relief units of the plurality of additional relief units and forming a flat surface, and
the comfort layer includes an aperture which is in fluid communication with the aperture in the relief layer and the aperture in the support layer.

21. The mattress structure as claimed in claim 20, wherein
the mattress structure further includes a chassis containing the main relief units and the additional relief units,
the chassis includes an air permeable structure establishing air communication with the apertures in the relief layer, in the support layer, and in the comfort layer, as an air passage.

22. The mattress structure as claimed in claim 20, further including at least one supplementary support unit which is positioned between the relief layer and the comfort layer.

23. The mattress structure as claimed in claim 22, wherein
the two main relief units provide a higher pressure relief effect than the additional relief units of the plurality of additional relief units, and
the supplementary support unit is located between the two main relief units.

24. The mattress structure as claimed in claim 14, wherein each chassis area contains a support unit.

* * * * *